US010106350B2

(12) United States Patent
Furusawa et al.

(10) Patent No.: US 10,106,350 B2
(45) Date of Patent: Oct. 23, 2018

(54) SHEET CONVEYING APPARATUS AND IMAGE FORMING APPARATUS

(71) Applicant: CANON KABUSHIKI KAISHA, Tokyo (JP)

(72) Inventors: Motohiro Furusawa, Shizuoka (JP); Atsushi Ogata, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/716,339

(22) Filed: Sep. 26, 2017

(65) Prior Publication Data

US 2018/0093846 A1 Apr. 5, 2018

(30) Foreign Application Priority Data

Sep. 30, 2016 (JP) ..... 2016-193513

(51) Int. Cl.

| | |
|---|---|
| ***B65H 5/06*** | (2006.01) |
| ***B65H 15/00*** | (2006.01) |
| ***B65H 7/14*** | (2006.01) |
| ***B65H 29/12*** | (2006.01) |
| ***G03G 15/23*** | (2006.01) |
| ***G03G 15/00*** | (2006.01) |
| ***B65H 85/00*** | (2006.01) |

(Continued)

(52) U.S. Cl.

CPC ..... *B65H 5/062* (2013.01); *B65H 7/14* (2013.01); *B65H 15/00* (2013.01); *B65H 29/125* (2013.01); *B65H 85/00* (2013.01); *G03G 15/231* (2013.01); *G03G 15/234* (2013.01); *G03G 15/6552* (2013.01); *G03G 15/6579* (2013.01); *B41J 11/04* (2013.01); *B65H 3/0638* (2013.01); *B65H 2301/333* (2013.01); *B65H 2404/142* (2013.01); *B65H 2404/144* (2013.01); *B65H 2404/1421* (2013.01); *B65H 2404/152* (2013.01); *B65H 2404/2693* (2013.01); *B65H 2801/06* (2013.01); *B65H 2801/12* (2013.01)

(58) Field of Classification Search

CPC ..... B65H 5/062; B65H 15/00; B65H 29/125; B65H 85/00; B65H 2404/142; B65H 2404/1421

USPC ..... 271/304, 186, 291, 301

See application file for complete search history.

(56) References Cited

U.S. PATENT DOCUMENTS

2008/0296834 A1 12/2008 Matsubara
2014/0306396 A1* 10/2014 Lan ..... B65H 5/06 271/3.19

(Continued)

FOREIGN PATENT DOCUMENTS

| | | |
|---|---|---|
| EP | 0564291 A2 | 10/1993 |
| EP | 2862829 A1 | 4/2015 |
| JP | 2005324922 A | 11/2005 |

(Continued)

*Primary Examiner* — David H Bollinger

(74) *Attorney, Agent, or Firm* — Canon U.S.A., Inc. IP Division

(57) ABSTRACT

A reversing unit has a drive roller, a discharge roller for forming a first nip portion N1 together with the drive roller, and a conveyance roller for forming a second nip portion together with the drive roller. The reversing unit moves any one of the rollers and nips a sheet at a plurality of nip portions when moving the roller to switch the nip portion for nipping a sheet from a first nip portion to a second nip portion and change the sheet conveyance direction from a first direction to a second direction.

19 Claims, 21 Drawing Sheets

(51) Int. Cl.
*B41J 11/04* (2006.01)
*B65H 3/06* (2006.01)

(56) References Cited

U.S. PATENT DOCUMENTS

2015/0091239 A1* 4/2015 Iwasawa ..... G03G 15/234
271/3.18
2015/0137443 A1* 5/2015 Yamamoto ..... B65H 85/00
271/3.2

FOREIGN PATENT DOCUMENTS

JP 2008285279 A 11/2008
JP 2015083353 A 4/2015

* cited by examiner

SHEET CONVEYING APPARATUS AND IMAGE FORMING APPARATUS

BACKGROUND OF THE INVENTION

Field of the Invention

The present invention relates to a sheet conveying apparatus for continuously conveying sheets, and an image forming apparatus, such as a copying apparatus, a printer, and a facsimile, having the sheet conveying apparatus.

Description of the Related Art

With the recent increase in demand for further resource saving on image forming apparatuses, the frequency of utilizing two-sided printing on such sheets as paper, overhead projector (OHP) sheets, plastic sheets, and cloths is increasing. Therefore, with an image forming apparatus having a two-sided printing function, importance is attached to the improvement in the number of sheets output per unit time or the productivity in two-sided printing.

As a conventional technique, Japanese Patent Application Laid-Open No. 2015-083353 discusses a configuration in which a reversing unit for performing sheet reversing includes a reversing roller group including a drive roller rotating in one direction while receiving a driving force, a first driven roller, and a second driven roller. In this reversing roller group configuration, the three different rollers (the first driven roller, the drive roller, and the second driven roller) are disposed in approximately one straight line in this order in the direction intersecting with the sheet conveyance direction. The first driven roller faces the drive roller to form a first nip portion. The second driven roller faces the drive roller from a direction different from the direction of the first driven roller to form a second nip portion.

The reversing unit discussed in Japanese Patent Application Laid-Open No. 2015-083353 performs the following sheet reversing. First of all, a sheet with an image formed on the first surface is conveyed toward the first nip portion of the reversing roller group. Then, the sheet is conveyed in the first direction as the direction of sheet discharge from the reversing roller group at the first nip portion, and the trailing edge of the sheet in the sheet conveyance direction passes through the first nip portion. The reversing unit includes a switchback unit for temporarily storing the sheet on the downstream side of the first nip portion in the sheet conveyance direction. The sheet that has passed through the first nip portion is stored in the switchback unit. Then, when the sheet temporarily stored in the switchback unit falls by self-weight, the trailing edge of the sheet is led to the second nip portion of the reversing roller group. Since the drive roller is rotating in one direction, the sheet nipped by the second nip portion is conveyed in the second direction opposite to the first direction as the sheet conveyance direction at the first nip portion. Then, the sheet is reconveyed to the image forming unit. After an image is formed on the second surface of the sheet, the sheet is conveyed to the discharge unit provided at a position different from the position of the reversing unit. Then, the sheet is discharged out of the image forming apparatus by the discharge roller of the discharge unit.

More specifically, in the configuration discussed in Japanese Patent Application Laid-Open No. 2015-083353, after the sheet has been completely discharged from the reversing roller group to the switchback unit, the sheet is temporarily stored in the switchback unit. Then, the nip portion for nipping a sheet is switched from the first nip portion to the second nip portion. When performing two-sided printing on a plurality of sheets, this configuration makes it possible to, while the first sheet passes through the first nip portion and is stored in the switchback unit, convey the second sheet following the first sheet to the first nip portion.

However, in the configuration discussed Japanese Patent Application Laid-Open No. 2015-083353 in which sheet reversing is made after completely discharging the sheet from the first nip portion of the reversing roller group, it is necessary to provide a switchback unit for temporarily storing the sheet on the downstream side of the reversing roller group in the sheet conveyance direction. When a switchback unit is provided, the sheet discharged from the reversing roller group is stored in the switchback unit. This makes it necessary to provide a discharge unit for discharging a sheet out of the image forming apparatus at a position different from the position of the reversing unit for reversing a sheet. This causes a problem of an increase in size of the apparatus.

SUMMARY OF THE INVENTION

The present invention is directed to a sheet conveying apparatus capable of switching the nip portion for nipping a sheet before the trailing edge of the sheet in the sheet conveyance direction has been completely discharged from a first nip portion.

To solve the above-described problem, a sheet conveying apparatus of the present invention includes a first rotary member configured to rotate in one direction, a second rotary member configured to convey a sheet in a first direction together with the first rotary member with a rotation of the first rotary member, a third rotary member configured to convey the sheet in a second direction different from the first direction together with the first rotary member with a rotation of the first rotary member, and a switching unit configured to move the second rotary member before a trailing edge of the sheet conveyed in the first direction has been conveyed by the first and the second rotary members to switch from a first state to a second state. The first state is a state where the second rotary member contacts a first surface of the sheet and the first rotary member contacts a second surface opposite to the first surface of the sheet. The second state is a state where the first rotary member contacts the first surface of the sheet and the third rotary member contacts the second surface of the sheet. When the switching unit moves the first rotary member, a third state where the sheet simultaneously contacts the first, the second, and the third rotary members is formed.

Further features of the present invention will become apparent from the following description of exemplary embodiments with reference to the attached drawings.

DESCRIPTION OF THE EMBODIMENTS

Exemplary embodiments of the present invention will be described in detail below with reference to the accompanying drawings. The following exemplary embodiments will be described centering on an example using a laser beam printer having a sheet conveying apparatus of the present invention. Components according to the following exemplary embodiments are to be considered as illustrative and not restrictive of the scope of the present invention.

Figure 1:
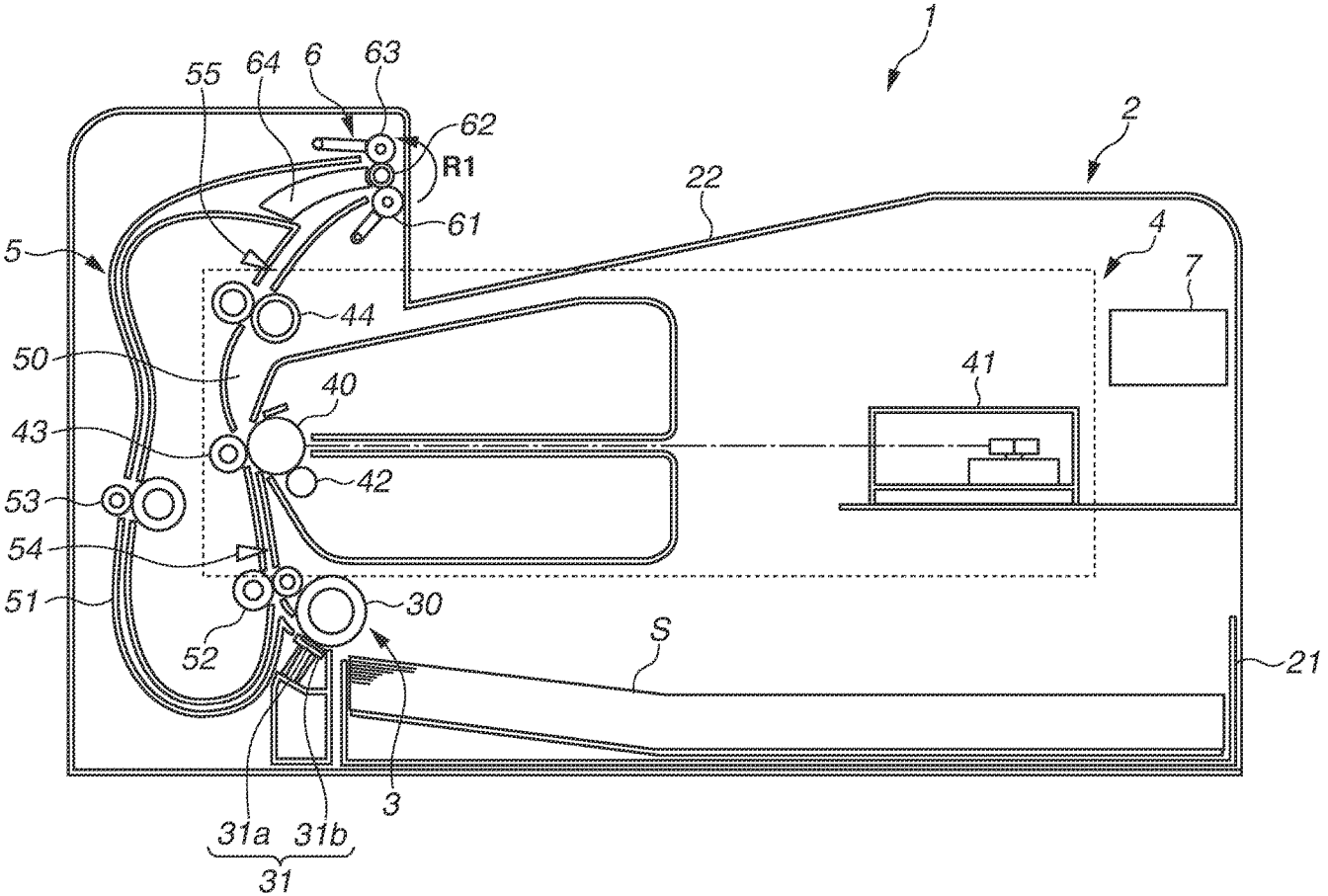
FIG. 1 is a sectional view schematically illustrating an overall configuration of an image forming apparatus according to a first exemplary embodiment.

A first exemplary embodiment will be described below. FIG. 1 is a sectional view schematically illustrating a configuration of an image forming apparatus having the sheet conveying apparatus of the present invention. As illustrated in FIG. 1, the image forming apparatus 1 includes a main body 2 of the image forming apparatus 1, a feed unit 3, an image forming unit 4, a conveyance unit 5, a reversing unit 6, and a control unit 7.

The main body 2 includes the feed unit 3, the image forming unit 4, the conveyance unit 5, the reversing unit 6, and the control unit 7. A sheet supplying cassette 21 as an accommodation unit is detachably attached on the upstream side of the feed unit 3 in the sheet conveyance direction. The sheet supplying cassette 21 feeds unprinted sheets S stored therein in a stacked state. When printing on a sheet S is completed, the sheet S is discharged onto a discharge tray 22 serving as a stacking unit for stacking sheets discharged from the main body 2. The discharge tray 22 is formed on the downstream side of the reversing unit 6 in the sheet conveyance direction.

The feed unit 3 includes a feed roller 30 and a separation portion 31 formed of a separation pad 31*a* and a separation holder 31*b* for holding the separation pad 31*a*. The separation pad 31*a* is in pressure contact with the feed roller 30. The sheets S stored in the sheet supplying cassette 21 are fed to the separation portion 31 by the rotation of the feed roller 30. After the sheets S are separated one by one by the separation portion 31, a sheet S is fed to a first conveyance path 50.

The image forming unit 4 includes a photosensitive drum 40 as an image bearing member, a laser scanner unit 41, a development unit 42, a transfer roller 43, and a fixing unit 44. The laser scanner unit 41 irradiates the photosensitive drum 40 uniformly charged by a charging unit (not illustrated) based on image information. Then, an electrostatic latent image is formed on the surface of the photosensitive drum 40. The development unit 42 develops the electrostatic latent image to form a toner image on the surface of the photosensitive drum 40. The transfer roller 43 transfers the developed toner image onto the sheet S. The fixing unit 44 heats and pressurizes the sheet S to fix the toner image onto the sheet S. In this way, an image is formed on the sheet S in the image forming unit 4.

Figure 2:
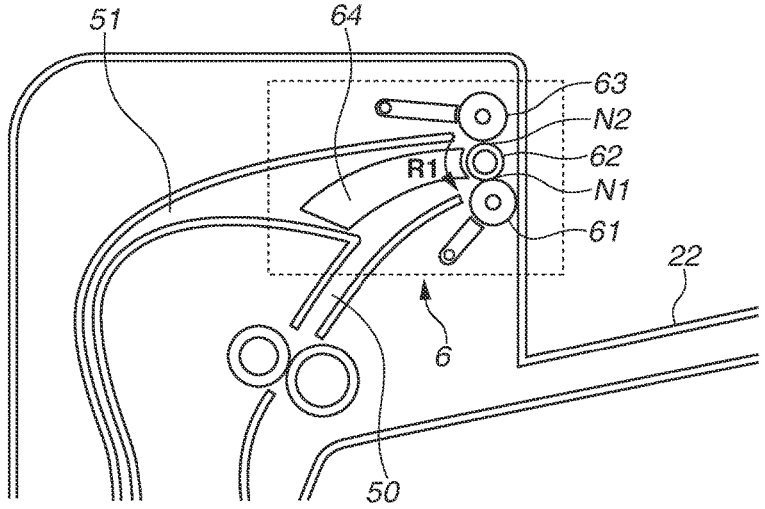
FIG. 2 is a sectional view schematically illustrating a reversing unit according to the first exemplary embodiment.

FIG. 2 is a sectional view schematically illustrating a configuration of the reversing unit 6 according to the present exemplary embodiment. The configuration of the reversing unit 6 will be described below with reference to FIG. 2. The reversing unit 6 includes a drive roller 62 (first rotary member) rotating in one direction (in the direction of the arrow R1) while receiving a driving force from a driving source, a discharge roller 61 (second rotary member) driven by the rotation of the drive roller 62, and a reversing roller 63 (third rotary member).

The discharge roller 61 contacts the drive roller 62 to form a first nip portion N1 at which the discharge roller 61 nips and conveys the sheet S together with the drive roller 62. The reversing roller 63 contacts the drive roller 62 at a position different from the position of the discharge roller 61 in the circumferential direction of the drive roller 62 to form a second nip portion N2 at which the reversing roller 63 nips and conveys the sheet S together with the drive roller 62.

When the drive roller 62 rotates, the drive roller 62 and the discharge roller 61 convey the sheet S from the drive roller 62 to the discharge tray 22 and then discharge the sheet S from the first nip portion N1. The direction in which the sheet S is discharged from the first nip portion N1 to the discharge tray 22 is referred to as a discharge direction (first direction). The drive roller 62 is rotating in one direction while receiving a driving force. Therefore, at the second nip portion N2, the sheet S is conveyed from the discharge tray 22 to the second conveyance path 51 in the second direction different from the sheet conveyance direction at the first nip portion N1. The direction in which the sheet S having been conveyed in the discharge direction toward the discharge tray 22 is conveyed from the discharge tray 22 to the reversing unit 6 is referred to as a reversing direction (second direction).

In other words, when the drive roller 62 rotates in one direction (in the direction of the arrow R1), the sheet S is conveyed in the first direction at the first nip portion N1 and conveyed in the second direction opposite to the first direction at the second nip portion N2. When the reversing unit 6 moves the discharge roller 61, the sheet S nip state is switched from the state of being nipped by the first nip portion N1 to the state of being nipped by the second nip portion N2. A moving operation of the discharge roller 61 for switching the sheet S nip state will be described in detail below.

As illustrated in FIG. 1, the conveyance unit 5 includes a first conveyance path 50, a second conveyance path 51, a conveyance roller pair 52, a re-conveyance roller pair 53, a first sensor 54, and a second sensor 55.

The first conveyance path 50 is used to convey the sheet S to the image forming unit 4 to reform an image on the sheet S conveyed from the sheet supplying cassette 21 and the sheet S conveyed in the reversing direction by the reversing unit 6. The downstream side of the first conveyance path 50 is connected to the first nip portion N1 of the reversing unit 6, and the upstream side of the first conveyance path 50 is divided into two paths in the sheet S conveyance direction. One of the two division paths of the first conveyance path 50 is connected to the sheet supplying cassette 21. The sheet S is fed from the sheet supplying cassette 21 to the first conveyance path 50. In the image forming unit 4, a toner image is transferred onto the sheet S by the transfer roller 43. The other of the two division paths of the first conveyance path 50 is connected to the second conveyance path 51 for re-conveying to the first conveyance path 50 the sheet S conveyed in the reversing direction by the reversing unit 6. The upstream side of the second conveyance path 51 is connected to the second nip portion N2 of the reversing unit 6, and the downstream side of the second conveyance path 51 is connected to the other of the two division paths of the first conveyance path 50 in the sheet conveyance direction.

The conveyance roller pair 52 disposed in the first conveyance path 50 conveys along the first conveyance path 50 the sheet S fed or conveyed in the first conveyance path 50. The re-conveyance roller pair 53 disposed in the second conveyance path 51 conveys to the first conveyance path 50 the sheet S conveyed in the second conveyance path 51.

The first sensor 54 disposed between the feed unit 3 and the image forming unit 4 in the first conveyance path 50 detects the positions of the leading and trailing edges of the sheet S passing through the first sensor 54. The second sensor 55 disposed on the downstream side of the first conveyance path 50 in the sheet conveyance direction detects the positions of the leading and trailing edges of the sheet S passing through the second sensor 55, similar to the first sensor 54. Each of the first sensor 54 and the second sensor 55 according to the present exemplary embodiment includes a sensor flag (not illustrated) biased in the direction of contact with the sheet S and rotated by the passage of the sheet S, and a photo-interrupter (not illustrated) as an optical sensor. In such a configuration, when the sheet S passes through each sensor, the sensor flag is pushed down and rotated to block or open the detection area of the photo-interrupter, making it possible to detect the leading and trailing edges of the sheet S.

Although, in the present exemplary embodiment, the first sensor 54 and the second sensor 55 include a sensor flag which is rotated by the passage of the sheet S, a sensor for detecting the leading and trailing edges of the sheet S is not limited thereto. For example, the first sensor 54 and the second sensor 55 may be an optical sensor for detecting the presence or absence of the sheet S. In this case, a light emitting element irradiates the sheet S with light and a light receiving element receives penetrated or reflected light.

The control unit 7 controls the drive related to the sheet S conveyance, such as the feed roller 30, the conveyance roller pair 52, the re-conveyance roller pair 53, and the reversing unit 6, and controls moving operations of the discharge roller 61 in the reversing unit 6. Control of operations of the reversing unit 6 by the control unit 7 will be described in detail below.

Figure 3:
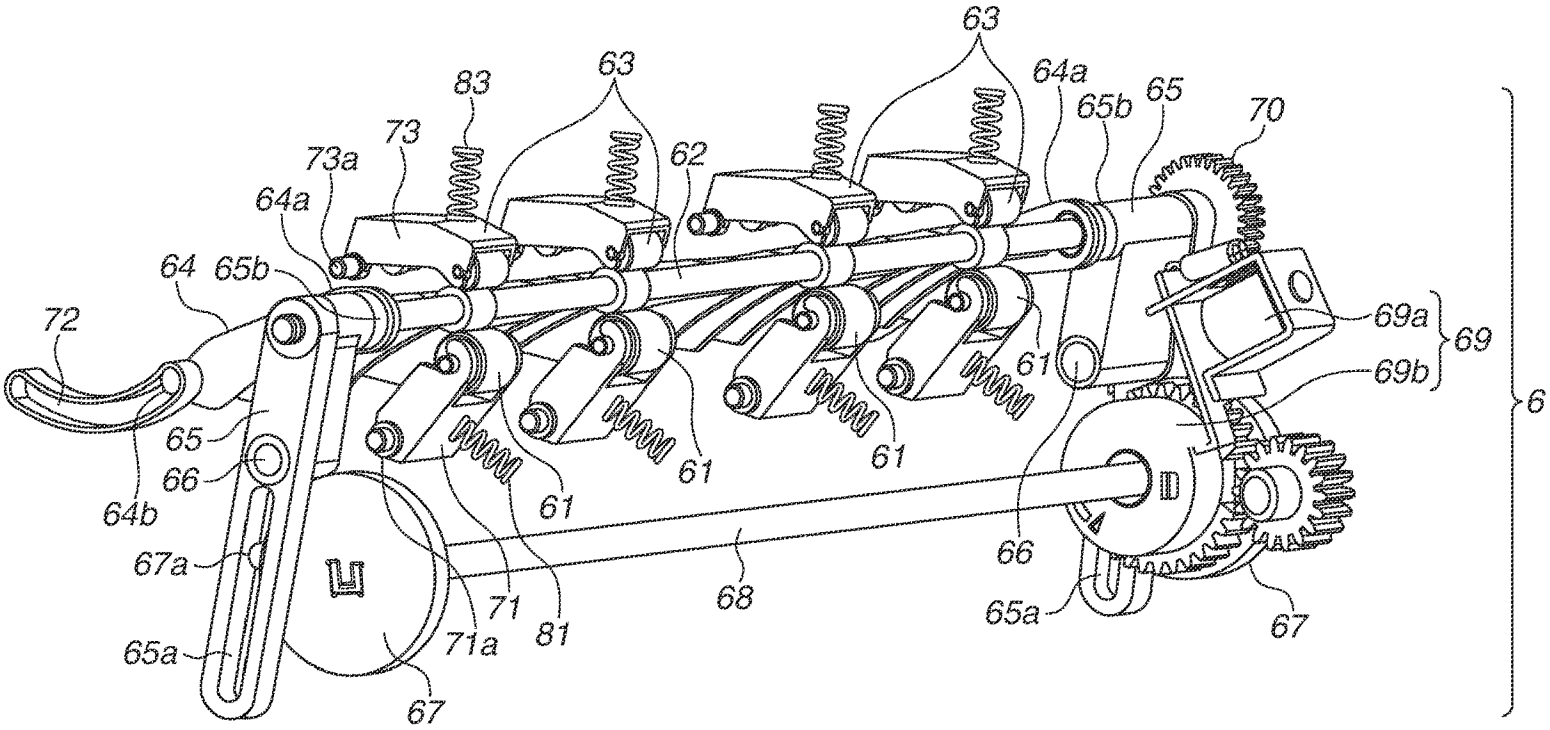
FIG. 3 is a schematic view illustrating a configuration of the reversing unit according to the first exemplary embodiment.
Figure 4:
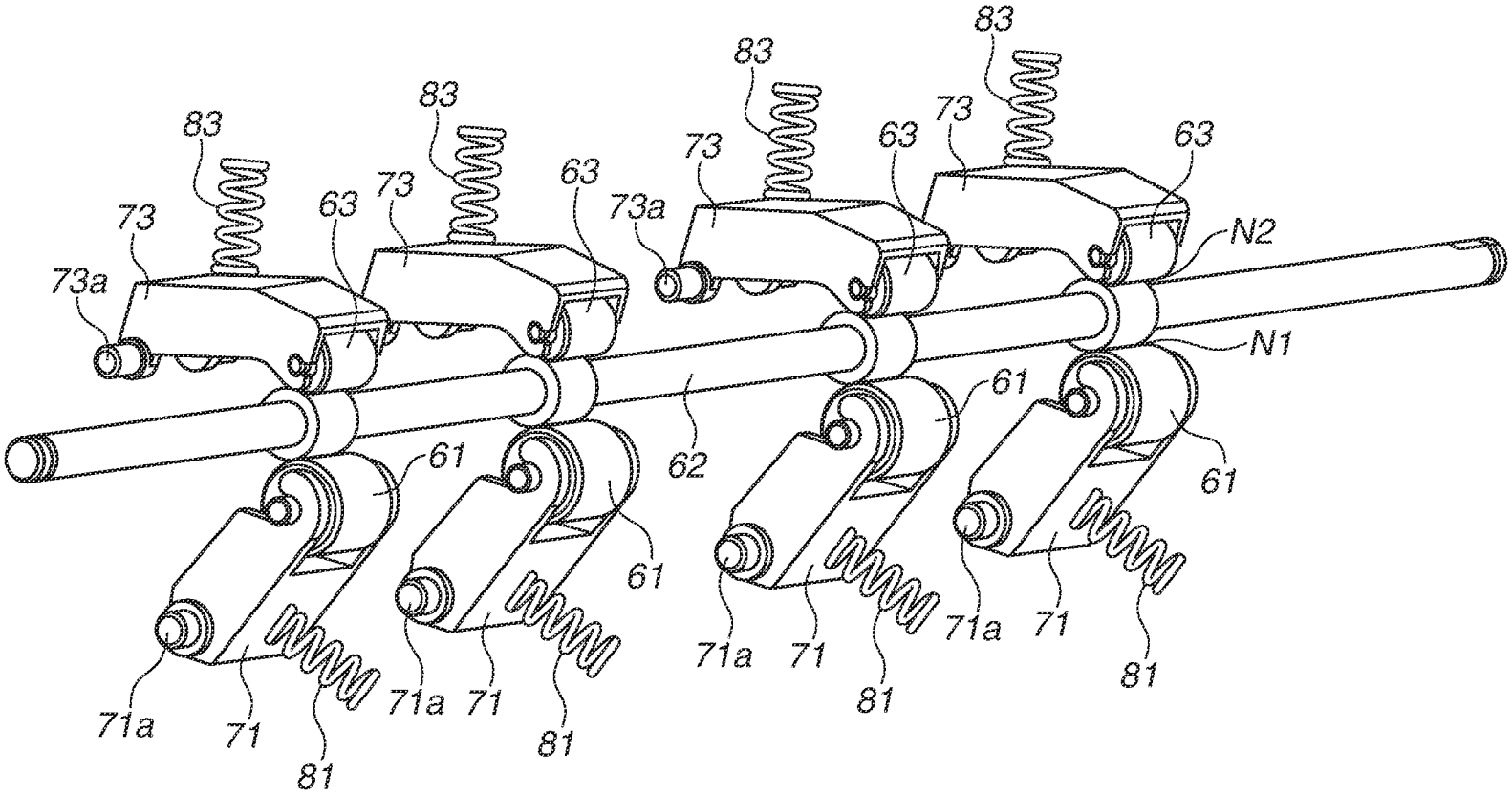
FIG. 4 is a schematic view illustrating a configuration of rotary members of the reversing unit according to the first exemplary embodiment.
Figure 5:
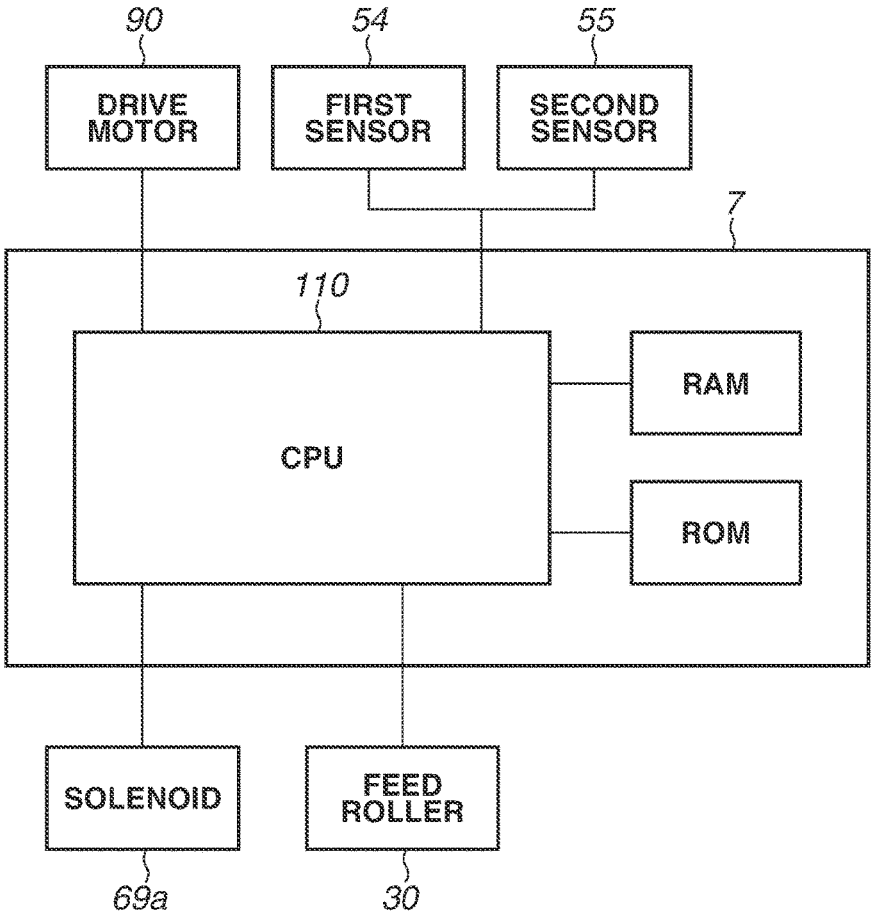
FIG. 5 is a block diagram illustrating drive control according to the first exemplary embodiment.

A configuration of the reversing unit 6 according to the present exemplary embodiment will be described below with reference to FIGS. 3 to 5. FIG. 3 is a schematic view illustrating a configuration of the reversing unit 6 according to the present exemplary embodiment when viewed from the downstream side in the sheet conveyance direction. FIG. 4 is a schematic view illustrating a configurations of the discharge rollers 61, the drive roller 62, and the reversing rollers 63 according to the present exemplary embodiment. FIG. 5 is a block diagram illustrating drive control according to the present exemplary embodiment.

As illustrated in FIG. 3, in the reversing unit 6, both ends of the drive roller 62 are rotatably held by drive roller holders 65 which are rotatable centering on fulcrums 66. The drive roller holder 65 holds the drive roller 62 on one side of the fulcrum 66 and is provided with a guide groove 65*a* on the other side.

A cam shaft 68 is disposed to face the drive roller 62 in approximately parallel with the drive roller 62. Both ends of the cam shaft 68 are provided with cams 67 which are integrally rotatable with the cam shaft 68. A cam 67 has a cylindrical protruding portion 67*a* on a surface different from the surface holding the cam shaft 68. When the protruding portion 67*a* engages with the guide groove 65*a*, the cam 67 is held by the drive roller holder 65. One end of the cam shaft 68 is provided with a cam drive unit 69 (formed of a solenoid 69*a* as a changeover member, and a partially-toothless gear 69*b*) that can turn the drive for rotating the cam 67 ON and OFF.

The reversing guide 64 are supported by both ends of the drive roller 62 in the axial direction. One end portion 64*a* of the reversing guide 64 on the side of the drive roller 62 is rotatably held by a bearing portion 65*b* of the drive roller holder 65. The other end of the reversing guide 64 is provided with a cylindrical protruding portion 64*b*. When the protruding portion 64*b* engages with a groove portion 72 provided in the main body 2, the orientation of the reversing guide 64 is maintained.

As illustrated in FIG. 4, each discharge roller 61 contacts the drive roller 62 to form a first nip portion N1, and is held by a discharge roller holder 71 movable centering on a fulcrum 71*a*. The discharge roller holder 71 is biased toward the drive roller 62 by a spring 81 (first biasing member) provided in the main body 2. The drive roller 62 being pressed by the discharge roller 61 forms the first nip portion N1.

Each reversing roller 63 contacts the drive roller 62 to form a second nip portion N2, and is held by a reversing roller holder 73 movable centering on a fulcrum 73*a*. The reversing roller holder 73 is biased toward the drive roller 62 by a spring 83 (second biasing member) provided in the main body 2. The drive roller 62 being pressed by the reversing roller 63 forms the second nip portion N2.

A block diagram illustrating drive control according to the present exemplary embodiment will be described below with reference to FIG. 5. The drive roller with one end connected to a gear 70 rotates while receiving a driving force from a drive motor 90 as a driving source via the gear 70. The drive motor 90 rotates in one direction, and the drive roller 62 also rotates in one direction. As illustrated in FIG. 5, the CPU 110 is connected with the drive motor 90, the solenoid 69*a*, the feed roller 30, the first sensor 54, and the second sensor 55. The CPU 110 is connected with a read only memory (ROM) and a random access memory (RAM), and executes a program stored in the ROM by using the RAM as a work memory. According to the present exemplary embodiment, the CPU 110, the ROM, and the RAM constitute the control unit 7. According to the present exemplary embodiment, when the control unit 7 controls the drive motor 90 and the solenoid 69*a*, the drive roller 62 rotates and the cam drive unit 69 moves the drive roller 62 in the reversing unit 6.

A moving operation of the drive roller 62 in the reversing unit 6 will be described below with reference to FIGS. 6A to 6C.

Figure 6A:
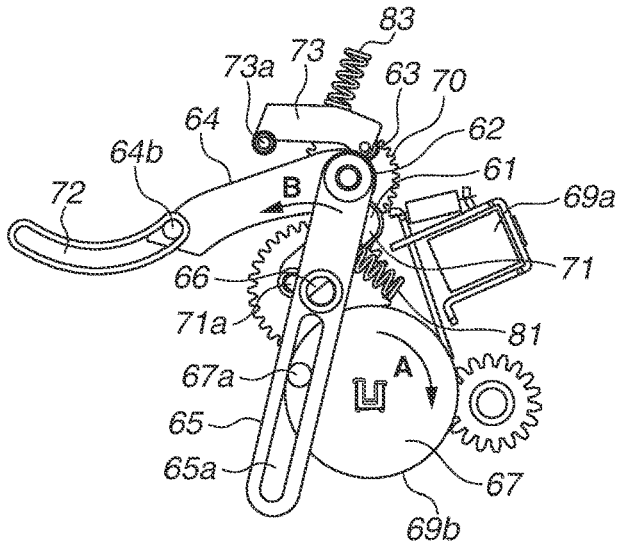
FIGS. 6A, 6B, and 6C are schematic views illustrating a configuration of the reversing unit and an operation of a drive roller according to the first exemplary embodiment.

FIG. 6A is a schematic view when the reversing unit 6 before the moving operation of the drive roller 62 is performed is viewed from the axial direction of the drive roller 62. The position of the drive roller 62 at this timing is the initial position (first position). At the initial position, the drive roller 62 is rotating in one direction while receiving a driving force from the driving source.

In the state illustrated in FIG. 6A, when the solenoid 69*a* turns ON to unlock the partially-toothless gear 69*b*, the drive is transferred to the partially-toothless gear 69*b*, and the cam 67 rotates in the direction of the arrow A (clockwise direction). At this timing, with the rotation of the cam 67, the protruding portion 67*a* engaging with the guide groove 65*a* of the drive roller holder 65 rotates in the direction of the arrow A (clockwise direction), and the drive roller holder 65 rotates in the direction of the arrow B (counterclockwise direction) centering on the fulcrum 66. Accordingly, the drive roller 62 held on both ends by the drive roller holders 65 moves in the direction away from the discharge roller 61 and the reversing roller 63 (in the direction of the arrow B). The reversing guides 64 are supported by both ends of the drive roller 62. One end portion 64*a* of the reversing guide 64 is held by the drive roller holder 65. Therefore, the reversing guide 64 moves together with the drive roller 62. Since the protruding portion 64*b* of the reversing guide 64 engages with the groove portion 72, the reversing guide 64 moves along with the groove portion while changing the angle with respect to the drive roller holder 65. At this timing, the gear 70 connected with one end of the drive roller 62 also moves together with the drive roller 62. Even during movement, the drive roller 62 rotates in one direction while receiving a driving force from the drive motor 90 as a driving source.

Figure 6B:
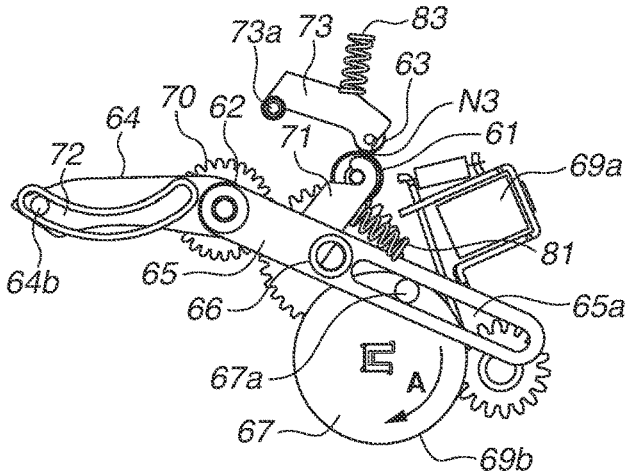

FIG. 6B is a schematic view illustrating the reversing unit 6 when the drive roller 62 and the reversing guide 64 move by the rotation of the cam 67 and the moving amount of the drive roller 62 is maximized, when viewed from the axial direction of the drive roller 62. At this timing, the drive roller 62 is positioned at a retracted position (second position) where the drive roller 62 is retracted from the initial position.

The discharge roller 61 held by the discharge roller holder 71 is biased toward the drive roller 62 by the spring 81 provided in the main body 2. When the drive roller 62 moves, the discharge roller holder 71 rotates centering on the fulcrum 71*a*, and the discharge roller 61 moves toward the reversing roller 63.

The reversing roller 63 held by the reversing roller holder 73 is biased toward the drive roller 62 by the spring 83 provided in the main body 2. When the drive roller 62 moves, the reversing roller holder 73 rotates centering on the fulcrum 73*a*, and the reversing roller 63 moves toward the discharge roller 61. At this timing, the rotational angle of the discharge roller holder 71 is regulated up to the position illustrated in FIG. 6B by a regulation member (not illustrated). The reversing roller 63 moves up to a position where it contacts the discharge roller 61 stopped at the position illustrated in FIG. 6B. Then, the reversing roller 63 and the discharge roller 61 contact each other to form a third nip portion N3 which can nip and hold the conveyed sheet S.

Figure 6C:
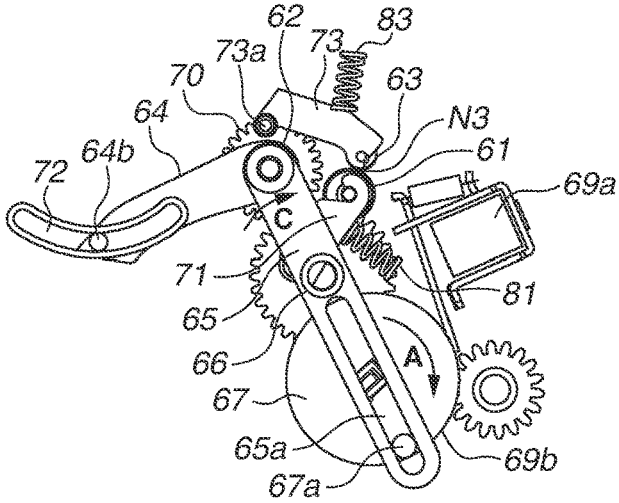

Then, as illustrated in FIG. 6C, when the cam 67 further rotates in the direction of the arrow A (clockwise direction), the drive roller holder 65 rotates in the direction of the arrow C (clockwise direction) centering on the fulcrum 66. Then, the reversing guide 64 moves along with guidance of the groove portion 72. The drive roller 62 approaches the discharge roller 61 and the reversing roller 63, and moves from the retracted position to the initial position. When the protruding portion 67*a* returns to the position illustrated in FIG. 6A, the drive is canceled by the partially-toothless gear 69*b* and the rotation of the cam 67 stops. At this timing, since the solenoid 69*a* has already been turned OFF, the cam 67 is locked at the position where the drive is canceled. More specifically, the above-described sequential moving operation of the drive roller 62 in the reversing unit 6 continuously takes place while the cam 67 makes one revolution by the cam drive unit 69. Since the drive roller 62 moves together with the gear 70, the drive roller 62 continues rotating in one direction while receiving a driving force from the drive motor 90 via the gear 70 during the above-described sequential moving operation of the drive roller 62 with respect to the discharge roller 61 and the reversing roller 63.

Figure 7:
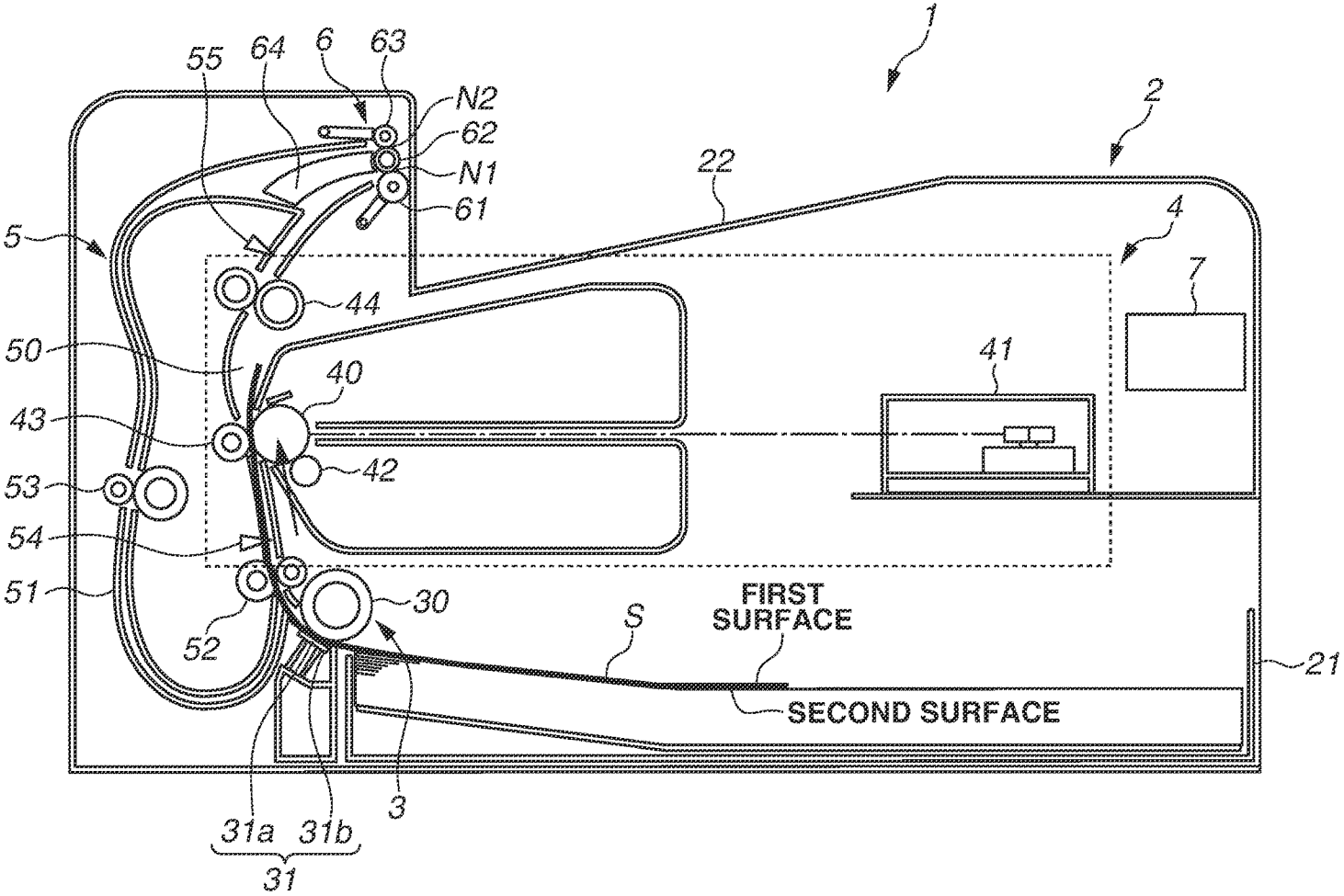
FIG. 7 is a sectional view schematically illustrating a sheet conveyance operation in two-sided printing according to the first exemplary embodiment.

FIG. 7 is a sectional view schematically illustrating a state after the sheet S stored in the sheet supplying cassette 21 is fed by the feed roller 30. As illustrated in FIG. 7, the sheet S taken out from the sheet supplying cassette 21 by the feed roller 30 is separated by the separation portion 31, fed to the first conveyance path and conveyed to the image forming unit 4 by the conveyance roller pair 52. Then, the leading edge of the sheet S is detected by the first sensor 54, and an image is formed on the first surface of the sheet S in the image forming unit 4 at a timing based on detection information.

Figure 8:
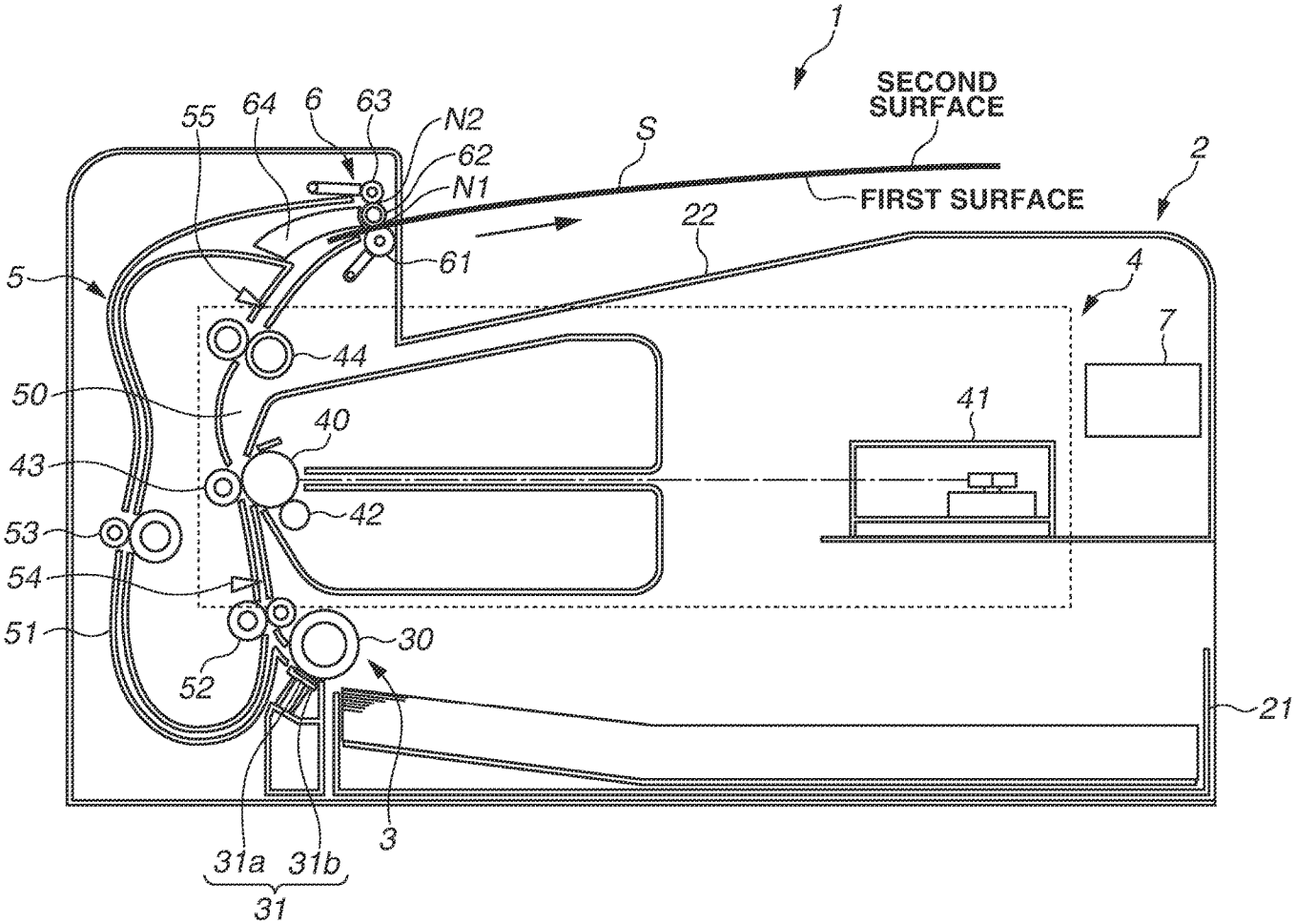
FIG. 8 is a sectional view schematically illustrating another sheet conveyance operation in two-sided printing according to the first exemplary embodiment.

FIG. 8 is a sectional view schematically illustrating a state after the sheet S with an image formed on the first surface has been conveyed to the reversing unit 6 and immediately before a moving operation of the drive roller 62 is started. After the toner image transferred on the first surface of the sheet S is fixed by the fixing unit 44, the sheet S is nipped by the first nip portion N1 formed by the drive roller 62 and the discharge roller 61 and conveyed in the direction of the arrow drawn by a solid line (first direction). At this timing, the sheet S is conveyed in the first direction in a state (first state) where the first surface contacts the discharge roller 61 and the second surface contacts the drive roller 62.

The trailing edge of the sheet S in contact with the drive roller 62 and the discharge roller 61 at the first nip portion N1 is detected by the second sensor 55. Based on the detection information, the drive roller 62 starts moving before the trailing edge of the sheet S has been conveyed at the first nip portion N1. More specifically, according to the present exemplary embodiment, the discharge roller 61 starts moving before the trailing edge of the sheet S completely exits the first nip portion N1. When the sheet S nipped at the first nip portion N1 has been conveyed in the first direction, the sheet S is then nipped by the second nip portion N2 with the movement of the drive roller 62. The movement of the drive roller 62 is started when the control unit 7 controls the solenoid 69*a* based on the detection information from the second sensor 55. The control unit 7 may perform control to start the movement of the drive roller 62 based on information about the detection of the leading edge of the sheet S by the second sensor 55. A moving operation of the drive roller 62 when the sheet S nip state is switched from the state of being nipped by the first nip portion N1 to the state of being nipped by the second nip portion N2 will be described in detail below with reference to FIGS. 11A to 11E.

Figure 9:
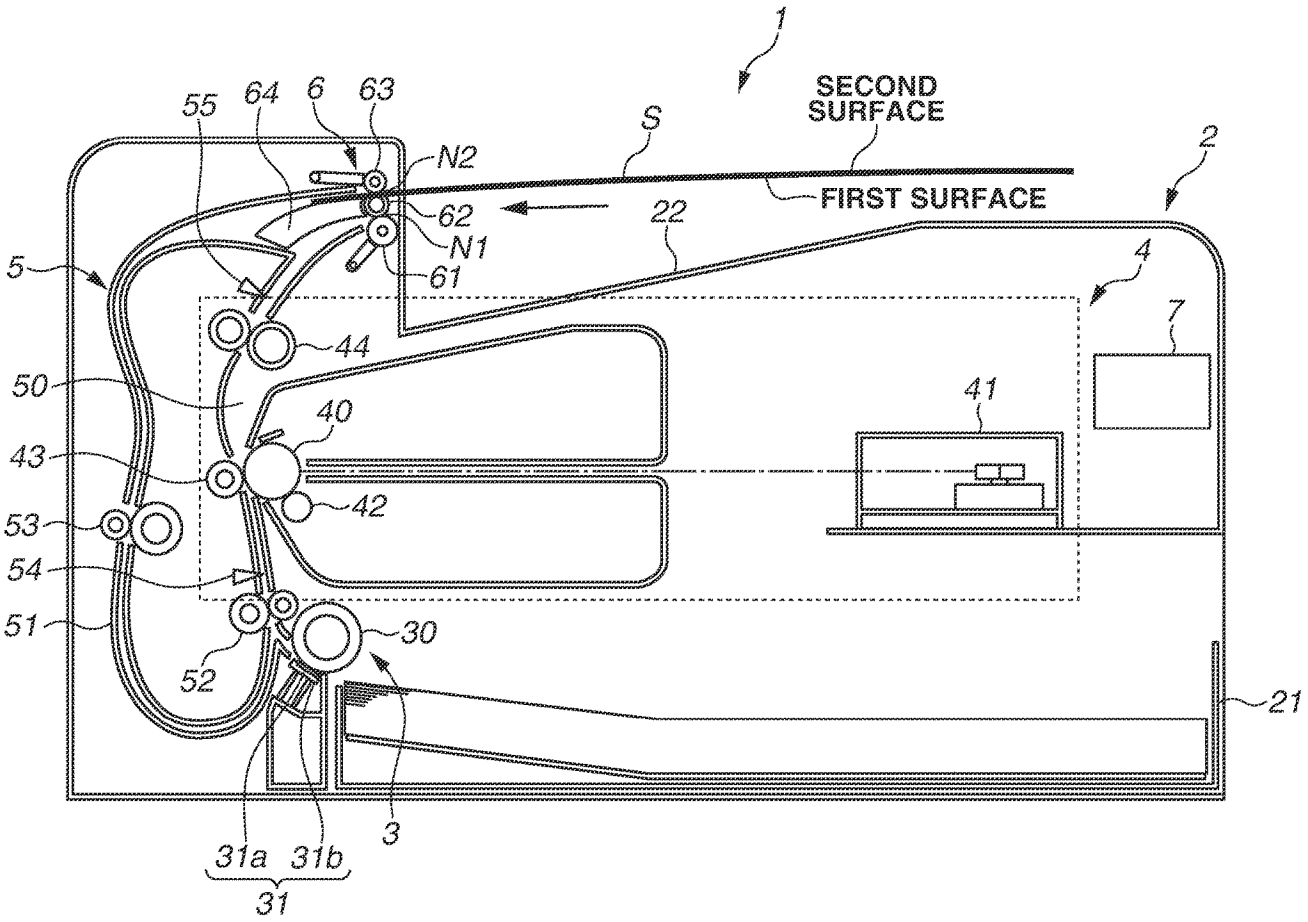
FIG. 9 is a sectional view schematically illustrating still another sheet conveyance operation in two-sided printing according to the first exemplary embodiment.

FIG. 9 is a sectional view schematically illustrating a state where the sheet S is nipped at the second nip portion N2 after the moving operation of the drive roller 62. When the sheet S is nipped by the second nip portion N2 from the state of being nipped by the first nip portion N1 with the movement of the drive roller 62, the sheet S is conveyed in the direction of the arrow drawn by a solid line (second direction different from the first direction) at the second nip portion N2. At this timing, the sheet S is conveyed in the second direction in a state (second state) where the second surface contacts the reversing roller 63 and the first surface contacts the drive roller 62. Thus, the sheet S having been conveyed in the first direction at the first nip portion N1 is conveyed in the second direction at the second nip portion N2 and then conveyed to the second conveyance path 51.

Figure 10:
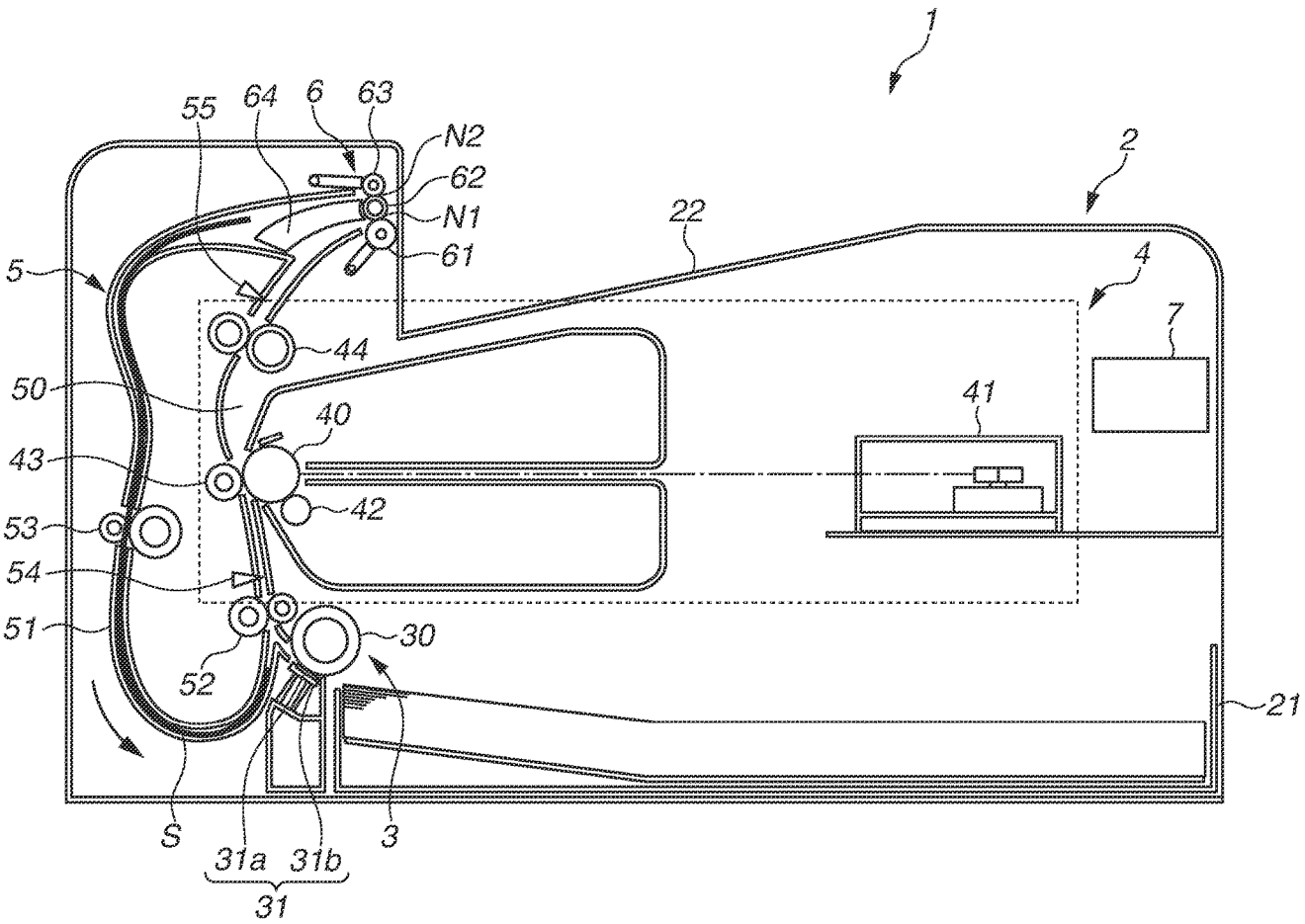
FIG. 10 is a sectional view schematically illustrating still another sheet conveyance operation in two-sided printing according to the first exemplary embodiment.

FIG. 10 is a sectional view schematically illustrating a state after the sheet S has been conveyed in the second direction and immediately before the sheet S is re-conveyed to the image forming unit 4. As illustrated in FIG. 10, the sheet S having been conveyed to the second conveyance path 51 is conveyed to the first conveyance path 50 by the re-conveyance roller pair 53. Then, in the image forming unit 4, a toner image is transferred to the second surface of the sheet S by the transfer roller 43, and the toner image formed on the second surface is fixed by the fixing unit 44. At this timing, toner images have been formed on both surfaces (the first and the second surfaces) of the sheet S. The sheet S with images formed on both surfaces is conveyed to the reversing unit 6, re-conveyed in the first direction at the first nip portion N1, and then discharged onto the discharge tray 22. At this timing, the drive roller 62 does not move. This completes two-sided printing on the sheet S according to the present exemplary embodiment.

As described above, in the present exemplary embodiment, a switching unit including the drive roller holders 65, the cams 67, the cam shaft 68, and the cam drive unit 69 moves the drive roller 62 to switch the sheet S nip state from the first state to the second state.

In the reversing unit 6, a moving operation of the drive roller 62 when the sheet S nip state is switched from the state of being nipped by the first nip portion N1 to state of being nipped by the second nip portion N2 will be described below with reference to FIGS. 11A to 11E.

Figure 11A:
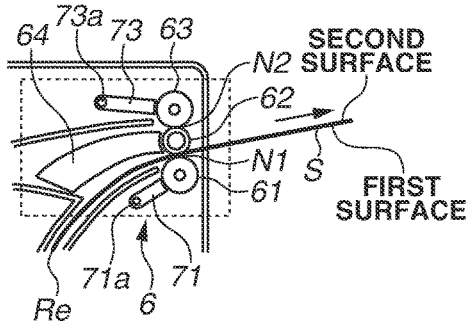
FIGS. 11A, 11B, 11C, 11D, and 11E are schematic views illustrating a moving operation of the drive roller according to the first exemplary embodiment.

FIG. 11A is a schematic view illustrating a state after the sheet S with an image formed on the first surface is conveyed to the first nip portion N1 and immediately before a moving operation of the drive roller 62 is started. At this timing, the drive roller 62 is rotating in one direction at the initial position (first position). As illustrated in FIG. 11A, after the sheet S contacts the drive roller 62 and the discharge roller 61 and before the trailing edge Re of the sheet S has been conveyed at the first nip portion N1, the drive roller 62 starts moving in the direction away from the discharge roller 61 and the reversing roller 63. The trailing edge Re of the sheet S according to the present exemplary embodiment refers to the most trailing edge of the sheet S in the first sheet S conveyance direction.

Figure 11D:
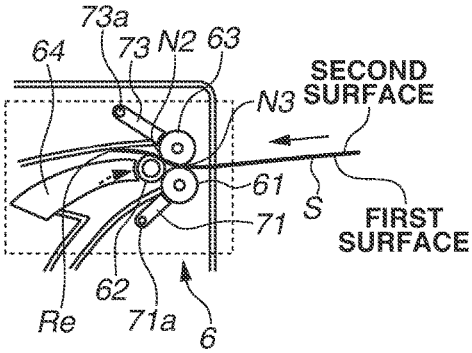
Figure 11B:
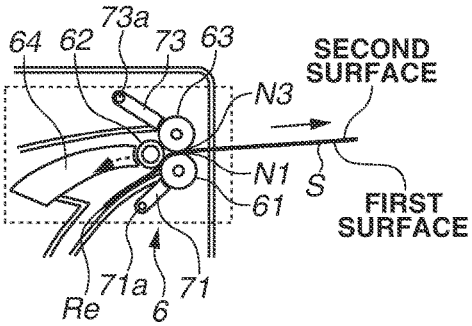

FIG. 11B is a schematic view illustrating a state where the drive roller 62 starts moving from the initial position (first position). In the state illustrated in FIG. 11B, the drive roller 62 contacts the discharge roller 61 to form a first nip portion N1. When the drive roller 62 moves, the reversing roller 63 biased by the spring 83 and the discharge roller 61 biased by the spring 81 contact each other via the sheet S to form a third nip portion N3. At this timing, the sheet S is nipped by the first nip portion N1 and the third nip portion N3 and conveyed in the first direction in a state (third state) where the first surface contacts the discharge roller 61 and the second surface contacts the drive roller 62 and the reversing roller 63. In other words, in the reversing unit 6, when the drive roller 62 moves from the initial position to the retracted position, the sheet S nip state is switched from the first state to the third state by the switching unit.

Thus, according to the present exemplary embodiment, when the drive roller 62 moves from the initial position to the retracted position, the third state where the sheet S is nipped by two different positions (the first nip portion N1 and the third nip portion N3) is formed. Then, the sheet S is nipped by the third nip portion N3. This prevents the sheet S from dropping from the reversing unit 6 when switching the sheet S nip portion by moving the drive roller 62.

Figure 11E:
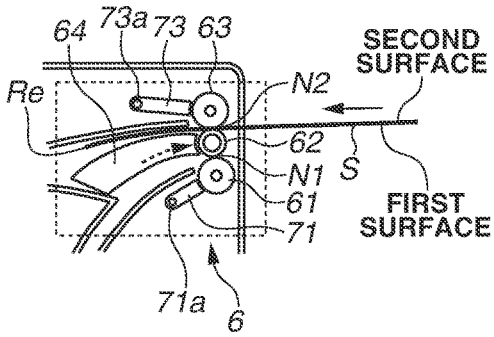
Figure 11C:
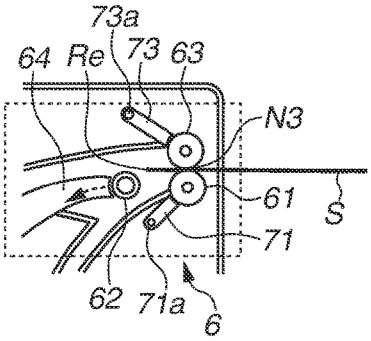

FIG. 11C is a schematic view illustrating a sheet S state when the drive roller 62 has moved to the retracted position where the moving amount of the drive roller 62 is maximized. The drive roller 62 moves to the upstream side of the trailing edge Re of the sheet S in contact with the drive roller 62 and the discharge roller 61 at the first nip portion N1 in the sheet S conveyance direction at the first nip portion N1.

As illustrated in FIG. 11C, when the drive roller 62 has moved from the initial position to the retracted position, the first nip portion N1 formed by the drive roller 62 and the discharge roller 61 is canceled, and the sheet S conveyance is suspended. At this timing, the sheet S having been conveyed in the first direction at the first nip portion N1 is nipped by the third nip portion N3 formed by the discharge roller 61 and the reversing roller 63, and the sheet S conveyance is held in a suspended state. When the drive roller 62 moves to the retracted position, the trailing edge Re of the sheet S nipped at the third nip portion N3 moves above the drive roller 62 having moved to the retracted position due to the self-weight and rigidity of the sheet S or the nipped position and angle of the sheet S at the third nip portion N3. In this state, the drive roller 62 moves from the lower surface side, i.e., the first surface of the sheet S nipped by the third nip portion N3 to approach the discharge roller 61 and the reversing roller 63, i.e., the drive roller 62 moves from the retracted position to the initial position.

FIG. 11D is a schematic view illustrating a sheet S state while the drive roller 62 is moving from the retracted position to the initial position. In the state illustrated in FIG.

11D, the discharge roller 61 and the reversing roller 63 contact each other to form a third nip portion N3, and the sheet S is nipped by the third nip portion N3. The drive roller 62 moving to the initial position contacts the reversing roller 63 via the sheet S to form a second nip portion N2. At this timing, the sheet S is nipped by the second nip portion N2 and the third nip portion N3 and conveyed in the second direction in a state (third state) where the first surface contacts the discharge roller 61 and the drive roller 62 and the second surface contacts the reversing roller 63. Subsequently, the drive roller 62 moves to the initial position so as to widen the space between the discharge roller 61 and the reversing roller 63.

FIG. 11E is a schematic view illustrating a sheet S state when the drive roller 62 has moved to the initial position. As illustrated in FIG. 11E, the drive roller 62 moves from the lower surface side of the sheet S to the initial position. Therefore, upon completion of the moving operation of the drive roller 62, the sheet S is nipped by the second nip portion N2 formed when the drive roller 62 and the reversing roller 63 contact each other. More specifically, the sheet S is nipped at the second nip portion N2 and conveyed in the second direction in a state (second state) where the first surface contacts the drive roller 62 and the second surface contacts the reversing roller 63. At this timing, the third nip portion N3 formed by the contact between the reversing roller 63 and the discharge roller 61 has been canceled, and a first nip portion N1 by the contact between the drive roller 62 and the discharge roller 61 has been formed.

Thus, according to the present exemplary embodiment, when the drive roller 62 moves from the retracted position to the initial position, the third state where the sheet S is nipped by two different positions (the second nip portion N2 and the third nip portion N3) is formed. Then, the sheet S is nipped by the second nip portion N2. In other words, in the reversing unit 6, when the drive roller 62 moves from the retracted position to the initial position, the sheet S nip state is switched from the third state to the second state by the switching unit. This prevents the sheet S from dropping from the reversing unit 6 when switching the sheet S nip portion by moving the drive roller 62.

As described above, in the present exemplary embodiment, the drive roller 62 is moved by the switching unit before the trailing edge Re of the sheet S conveyed in the first direction at the first nip portion N1 has been conveyed at the first nip portion N1. This enables switching the sheet S nip portion from the first nip portion N1 to the second nip portion N2, making it possible to change the sheet S conveyance direction from the first direction to the second direction, thus reversing the sheet S.

According to the present exemplary embodiment, when changing the sheet S nip state by the switching unit, a state of being nipped by two different positions (the first nip portion N1 and the third nip portion N3) and a state of being nipped by another two different positions (the second nip portion N2 and the third nip portion N3) are formed. However, the configuration is not limited thereto. Only the state where the sheet S is nipped by two different positions (the first nip portion N1 and the third nip portion N3) or the state where the sheet S is nipped by another two different positions (the second nip portion N2 and the third nip portion N3) may be formed. When changing the sheet S nip state from the first state to the second state, forming a state where the sheet S is nipped by any two nip portions enables obtaining the effect of preventing the sheet S from dropping from the reversing unit 6.

As described in background art, as a method for changing the sheet S conveyance direction, the sheet S is completely discharged from the first nip portion of the reversing roller group including a series of three rollers and then conveyed to the second nip portion. In such a configuration, providing a switchback unit for temporarily storing the sheet S on the downstream side of the reversing roller group in the sheet conveyance direction enables reversing the sheet S. In other words, when the sheet S having completely discharged from the first nip portion is temporarily stored in the switchback unit and then conveyed from the switchback unit to the second nip portion, the sheet conveyance direction is changed. In such a configuration, however, it is necessary to provide a discharge unit for discharging a sheet out of the image forming apparatus at a position different from the position of the reversing unit for reversing a sheet, possibly increasing the size of the apparatus.

In the configuration of the present exemplary embodiment, on the other hand, the sheet S nip portion is switched from the first nip portion N1 to the second nip portion N2 by moving the drive roller 62 before the trailing edge of the sheet S conveyed in the first direction has been conveyed at the first nip portion N1. More specifically, the sheet S nip portion can be switched before the trailing edge of the sheet S exits the reversing unit 6, making it possible to change the sheet conveyance direction to reverse the sheet S. Therefore, in the configuration of the present exemplary embodiment, it is not necessary to provide a regulation unit at a position different from the position of the reversing unit 6, making it possible to change the sheet S conveyance direction without increasing the size of the apparatus.

The present exemplary embodiment has been described above centering on the reversing unit 6 in which contact portions 61*b* of the discharge rollers 61, contact portions 62*b* of the drive roller 62, and contact portions 63*b* of the reversing rollers 63 are disposed at respectively facing positions. However, the configuration is not limited thereto. the contact portions 61*b* of the discharge rollers 61, the contact portions 62*b* of the drive roller 62, and the contact portions 63*b* of the reversing rollers 63 in the reversing unit 6 may be alternately disposed in comb shape.

A second exemplary embodiment will be described below. The first exemplary embodiment has been described above centering on a configuration in which the sheet S nip portion is switched from the first nip portion N1 to the second nip portion N2 by using three different rollers, the discharge rollers 61, the drive roller 62, and the reversing rollers 63. On the other hand, the second exemplary embodiment is configured to switch the sheet S nip portion from a first nip portion N11 to a second nip portion N12 by using the reversing unit 106 having sub rollers 174 in addition to discharge rollers 161, a drive roller 162, and reversing rollers 163. The configuration of the present exemplary embodiment is similar to that according to the first exemplary embodiment except that the sub rollers 174 are provided in the vicinity of the discharge rollers 161 in the reversing unit 106. Therefore, the present exemplary embodiment will be described below centering on the differences from the first exemplary embodiment with reference to FIGS. 12 and 13A to 13F. Descriptions of elements similar to those in the first exemplary embodiment will be omitted.

Figure 12:
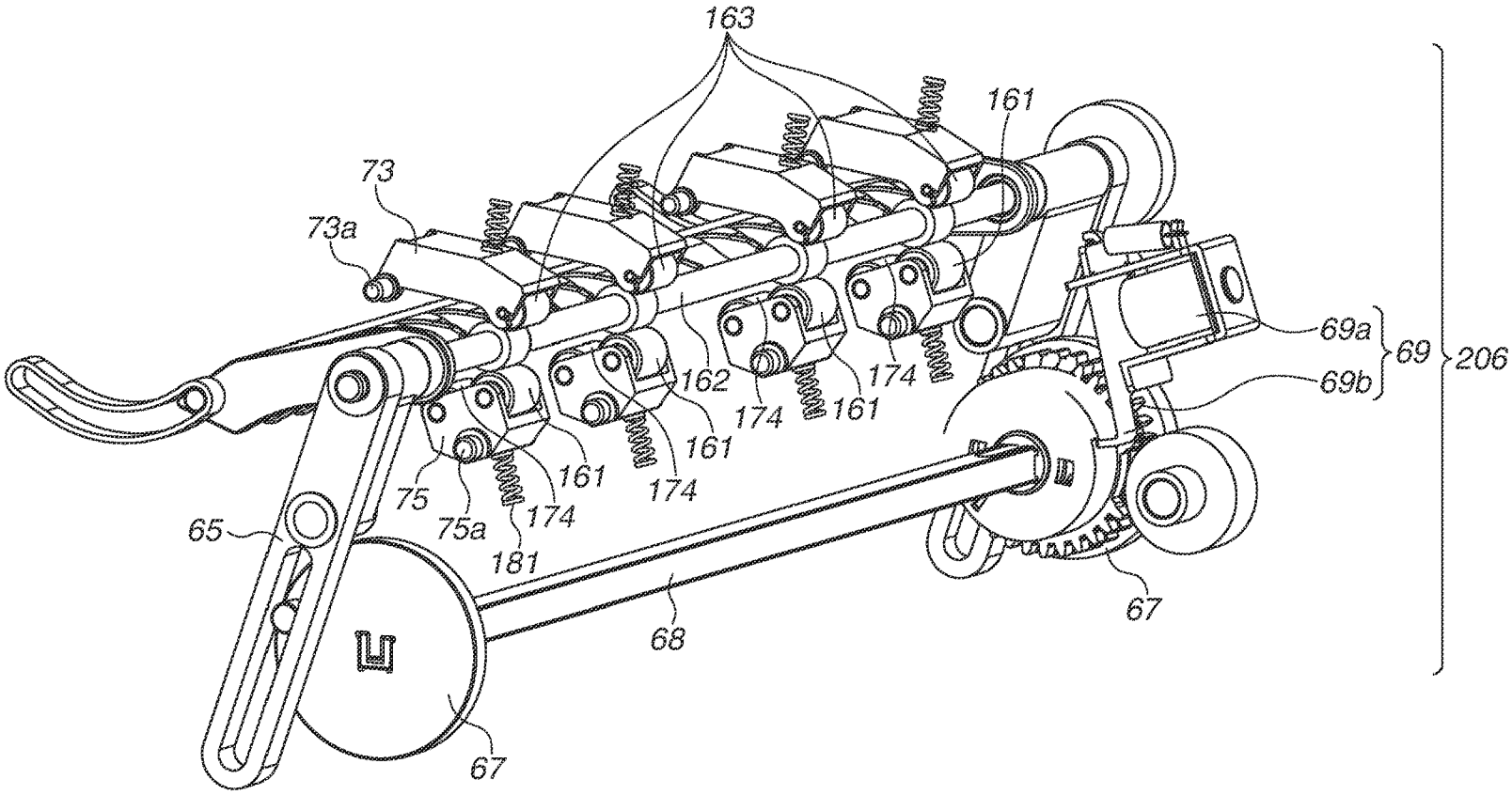
FIG. 12 is a schematic view illustrating a configuration of a reversing unit according to a second exemplary embodiment.

FIG. 12 is a schematic view illustrating a configuration of the reversing unit 106 when the reversing unit 106 having the sub rollers 174 disposed in the vicinity of the discharge rollers 161 conveys the sheet S. As illustrated in FIG. 12, in the present exemplary embodiment, a sub roller 174 as an auxiliary rotary member is provided in the vicinity of each discharge roller 161. The discharge roller 161 and the sub roller 174 are rotatably held by the discharge roller holder 75 (first holding member) which is movable centering on a fulcrum 75*a*. The discharge roller holder 75 is swingably biased toward the drive roller 162 by the spring 181 as a biasing member provided in the main body 2. When the discharge roller 161 is biased toward the drive roller 162, the discharge roller 161 and the drive roller 162 contact each other to form a first nip portion N11.

Figure 13A:
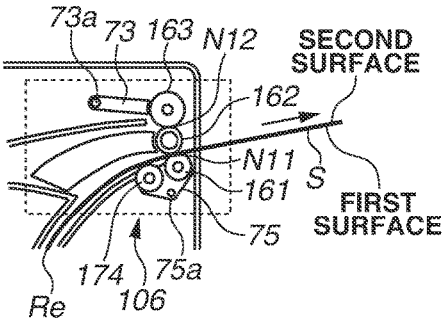
FIGS. 13A, 13B, 13C, 13D, 13E, and 13F are schematic views illustrating a moving operation of the drive roller according to the second exemplary embodiment.

FIG. 13A is a schematic view illustrating a state after the sheet S with an image formed on the first surface is conveyed to the first nip portion N11 and immediately before a moving operation of the drive roller 162 is started. At this timing, the drive roller 162 is rotating in one direction at the initial position (first position). Further, the sheet S is conveyed in the first direction in a state (first state) where the first surface contacts the discharge roller 161 and the sub roller 174 and the second surface contacts the drive roller 162. As illustrated in FIG. 13A, the drive roller 162 starts moving in the direction away from the discharge roller 161 and the reversing roller 163 before the trailing edge Re of the sheet S has been conveyed at the first nip portion N11.

Figure 13B:
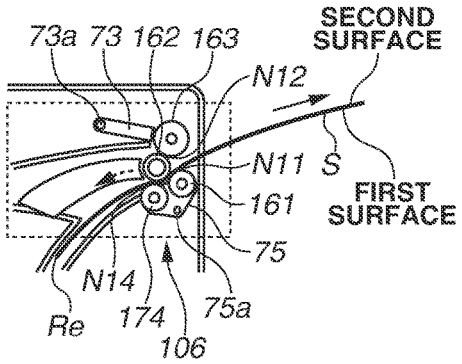

FIG. 13B is a schematic view illustrating a state where the drive roller 162 starts moving from the initial position. In the state illustrated in FIG. 13B, the drive roller 162 and the discharge roller 161 contact each other via the sheet S to form a first nip portion N11, and the drive roller 162 and the sub roller 174 contact each other to form a fourth nip portion N14. At this timing, the sheet S is nipped by two different positions (the first nip portion N11 and the fourth nip portion N14) and conveyed in the first direction as the direction of sheet discharge from the reversing unit 106. The sub roller 174 is disposed on the upstream side of the discharge roller 161 in the first direction. In the state illustrated in FIG. 13B, the sheet S is conveyed in a state where the first surface contacts the discharge roller 161 and the sub roller 174 and the second surface contacts drive roller 162.

Figure 13C:
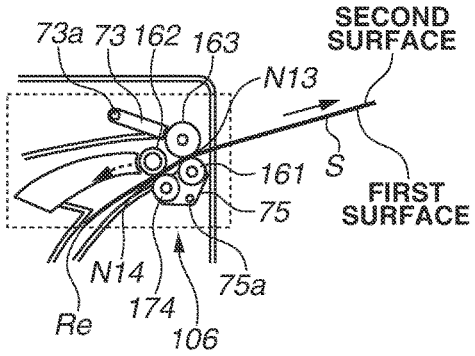

FIG. 13C is a schematic view illustrating a state where the drive roller 162 has further moved from the position illustrated in FIG. 13B. As illustrated in FIG. 13C, the discharge roller 161 and the reversing roller 163 contact each other via the sheet S to form a third nip portion N13, and the drive roller 162 and the sub roller 174 contact each other via the sheet S to form a fourth nip portion N14. In other words, the sheet S is conveyed in the first direction in a state (third state) where the first surface contacts the discharge roller 161 and the sub roller 174, the second surface contacts the drive roller 162 and the reversing roller 163, and the sheet S is nipped by the third nip portion N13 and the fourth nip portion N14. In the reversing unit 106, when the drive roller 162 moves from the initial state to the retracted position, the sheet S nip state is switched from the first state to the third state by the switching unit.

Figure 13D:
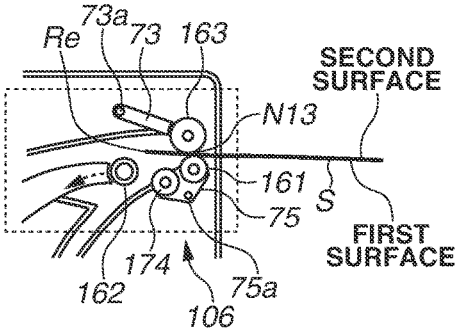

FIG. 13D is a schematic view illustrating a sheet S state when the drive roller 162 has moved to the retracted position (second position) where the moving amount of the drive roller 162 is maximized. As illustrated in FIG. 13D, when the drive roller 162 moves from the initial position to the retracted position, the first nip portion N11 formed by the drive roller 162 and the discharge roller 161 and the fourth nip portion N14 formed by the drive roller 162 and the sub roller 174 are canceled. At this timing, the conveyance of the sheet S is suspended, the sheet S is nipped at the third nip portion N13 formed by the discharge roller 161 and the reversing roller 163, and the sheet S conveyance is held in a suspended state.

Thus, according to the present exemplary embodiment, similar to the first exemplary embodiment, when the drive roller 162 moves from the initial position to the retracted position, the third state where the sheet S is nipped by two different positions is formed. Then, the sheet S is nipped by the third nip portion N13. This prevents the sheet S from dropping from the reversing unit 106 when switching the sheet S nip portion by moving the drive roller 162.

When the drive roller 162 moves to the retracted position, the trailing edge Re of the sheet S nipped at the third nip portion N13 moves above the drive roller 162 having moved to the retracted position due to the self-weight and rigidity of the sheet S or the nipped position and angle of the sheet S at the third nip portion N3. Therefore, the drive roller 162 moves from the lower surface side, i.e., the first surface of the sheet S nipped by the third nip portion N13 to approach the discharge roller 161 and the reversing roller 163, i.e., the drive roller 162 moves from the retracted position to the initial position.

Figure 13E:
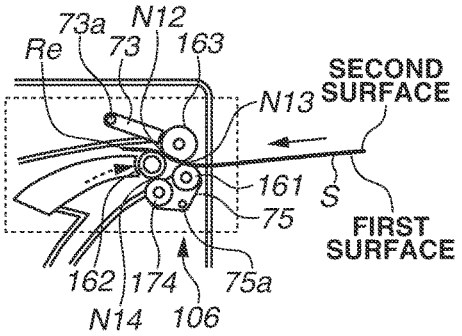

FIG. 13E is a schematic view illustrating a sheet S state while the drive roller 162 is moving from the retracted position to the initial position. As illustrated in FIG. 13E, the drive roller 162 moves from the lower surface side, i.e., the first surface of the sheet S nipped by the third nip portion N13 to approach the discharge roller 161 and the reversing roller 163, i.e., the drive roller 162 moves from the retracted position to the initial position. At this timing, the drive roller 162 contacts the reversing roller 163 via the sheet S to form a second nip portion N12, and the sheet S is nipped at the second nip portion N12 and the third nip portion N13. The reversing roller 163 is driven to rotate by the rotation of the drive roller 162, and the sheet S is conveyed in the second direction opposite to the first direction at the second nip portion N12. In other words, the sheet S is conveyed in the second direction in a state (third state) where the first surface contacts the discharge roller 161 and the drive roller 162, the second surface contacts the reversing roller 163, and the sheet S is nipped by the second nip portion N12 and the third nip portion N13.

Subsequently, the drive roller 162 moves to the initial position so as to widen the space between the discharge roller 161 and the reversing roller 163. Then, the third nip portion N13 formed by the contact between the discharge roller 161 and the reversing roller 163 is canceled, and the first nip portion N11 once formed by the contact between the drive roller 162 and the discharge roller 161 is reformed.

Figure 13F:
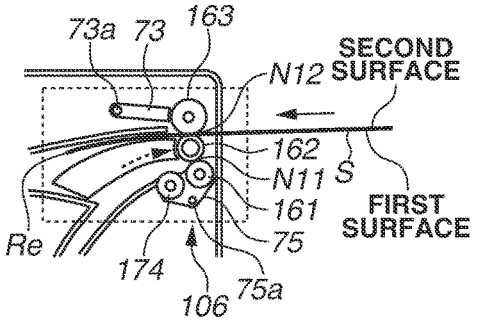

FIG. 13F is a schematic view illustrating a sheet S state when the drive roller 162 has moved to the initial position. As illustrated in FIG. 13F, upon completion of the moving operation of the drive roller 162, the sheet S having been held by the third nip portion N13 is nipped by the second nip portion N12 formed by the contact between the drive roller 162 and the reversing roller 163. In other words, the sheet S is nipped at the second nip portion N12 and conveyed in the second direction in a state (second state) where the first surface contacts the drive roller 162 and the second surface contacts the reversing roller 163.

Thus, according to the present exemplary embodiment, similar to the first exemplary embodiment, when the drive roller 162 moves from the retracted position to the initial position, the third state where the sheet S is nipped by two different positions (the second nip portion N12 and the third nip portion N13) is formed. Then, the sheet S is nipped by the second nip portion N12. More specifically, in the reversing unit 106, when the drive roller 162 moves from the retracted position to the initial position, the sheet S nip state is switched from the third state to the second state by the switching unit. This prevents the sheet S from dropping from the reversing unit 106 when switching the sheet S nip portion by moving the drive roller 162.

As described above, the configuration of the present exemplary embodiment also enables acquiring a similar effect to the first exemplary embodiment. According to the present exemplary embodiment, a switching unit including the drive roller holders 65, the cams 67, the cam shaft 68, and the cam drive unit 69 moves the drive roller 162 to switch the sheet S nip state from the first state to the second state.

According to the present exemplary embodiment, when changing the sheet S nip state by the switching unit, a state of being nipped by two different positions (the third nip portion N13 and the fourth nip portion N14) and a state of being nipped by another two different positions (the second nip portion N12 and the third nip portion N13) are formed. However, the configuration is not limited thereto. Only the state where the sheet S is nipped by two different positions (the third nip portion N13 and the fourth nip portion N14) or only the state where the sheet S is nipped by another two different positions (the second nip portion N12 and the third nip portion N13) may be formed. When changing the sheet S nip state from the first state to the second state, forming a state where the sheet S is nipped by any two nip portions enables obtaining the effect of preventing the sheet S from dropping from the reversing unit 106.

According to the present exemplary embodiment, providing the sub rollers 174 enables achieving favorable sheet S conveyance performance when the drive roller 162 moves from the initial position to the retracted position. This is because, in the present exemplary embodiment, the discharge roller 161 and the sub roller 174 contact each other via the sheet S to form a first nip portion N11 and a fourth nip portion N14 when the drive roller 162 moves from the initial position to the retracted position. The configuration in which the sheet S is nipped by two different nip portions (the first nip portion N11 and the fourth nip portion N14) provides a small curvature of the sheet S compared to the configuration of the first exemplary embodiment in which the sheet S is nipped by another two different positions (the first nip portion N1 and the third nip portion N3). This enables reducing the sheet S conveyance resistance, achieving favorable conveyance performance.

Figure 14:
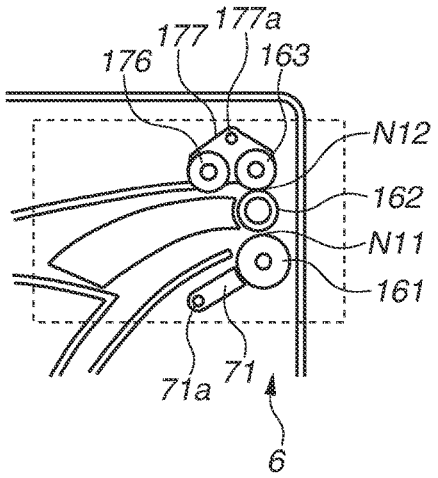
FIG. 14 is a schematic view illustrating another configuration of the reversing unit according to the second exemplary embodiment.

The present exemplary embodiment will be described below centering on the reversing unit 106 including the sub rollers 174 as auxiliary rotary members on the upstream side of the discharge rollers 161 in the vicinity of the discharge rollers 161 in the first sheet S conveyance direction. However, the configuration is not limited thereto. As illustrated in FIG. 14, a sub roller 176 as an auxiliary rotary member may be provided in the vicinity of and on the upstream side of the reversing roller 163 in the first sheet S conveyance direction. This configuration also enables acquiring a similar effect to the present exemplary embodiment.

As illustrated in FIGS. 15A to 15G, the reversing unit 206 including a plurality of auxiliary rotating members also enables acquiring a similar effect to the present exemplary embodiment. FIGS. 15A to 15G are schematic views illustrating a modification of the present exemplary embodiment in which a sub roller 274 as an auxiliary rotary member is provided on the upstream side of the discharge roller 261, and a sub roller 276 is provided on the upstream side of the reversing roller 263 in the first sheet S conveyance direction.

The sub rollers 274 and 276 according to the modification are disposed so as to be biased toward a drive roller 262 in a similar configuration to the sub roller 174 according to the present exemplary embodiment. In other words, the discharge roller 261 and the sub roller 274 are rotatably held by a discharge roller holder 275 (first holding member) which is movable centering on a fulcrum 275*a*. The reversing roller 263 and the sub roller 276 are rotatably held by a reversing roller holder 277 (second holding member) which is movable centering on a fulcrum 277*a*. The discharge roller holder 275 and the reversing roller holder 277 are swingably biased toward the drive roller 262 by springs (not illustrated) as biasing members provided in the main body 2. Thus, in a state before the drive roller 262 moves, the discharge roller 261 contacts the drive roller 262 to form a first nip portion N21, and the reversing roller 263 contacts the drive roller 262 to form a second nip portion N22.

Figure 15A:
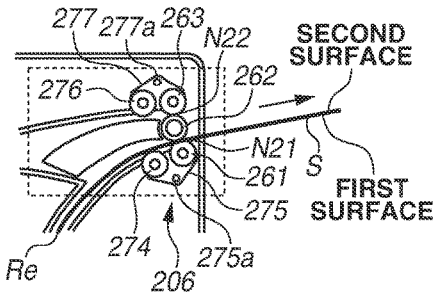
FIGS. 15A, 15B, 15C, 15D, 15E, 15F, and 15G are schematic views illustrating a moving operation of the drive roller in the reversing unit according to a modification of the second exemplary embodiment.

FIG. 15A is a schematic view illustrating a state after the sheet S with an image formed on the first surface is conveyed to the first nip portion N21 and immediately before a moving operation of the drive roller 262 is started. At this timing, the drive roller 262 is rotating in one direction at the initial position (first position). The sheet S is conveyed in the first direction in a state (first state) where the first surface contacts the discharge roller 261 and the sub roller 274 and the second surface contacts drive roller 262. As illustrated in FIG. 15A, the drive roller 262 starts moving in the direction away from the discharge roller 261 and the reversing roller 263 before the trailing edge Re of the sheet S has been conveyed at the first nip portion N21.

Figure 15B:
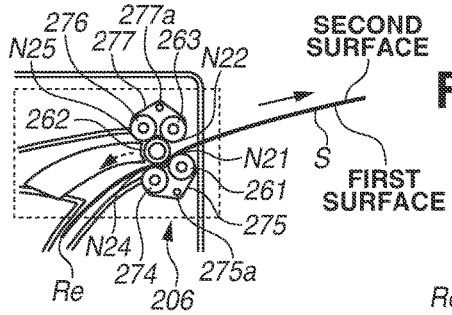

FIG. 15B is a schematic view illustrating a state where the drive roller 262 starts moving from the initial position. In the state illustrated in FIG. 15B, the drive roller 262 and the discharge roller 261 contact each other via the sheet S to form a first nip portion N21, and the drive roller 262 and the sub roller 274 contact each other to form a fourth nip portion N24. At this timing, the sheet S is nipped by two different positions (the first nip portion N21 and the fourth nip portion N24) and conveyed in the first direction as the direction of sheet discharge from the reversing unit 206. The sub roller 274 is formed on the upstream side of the discharge roller 261 in the first direction. In the state illustrated in FIG. 15B, the sheet S is conveyed in a state where the first surface contacts the discharge roller 261 and the sub roller 274 and the second surface contacts drive roller 262.

Figure 15C:
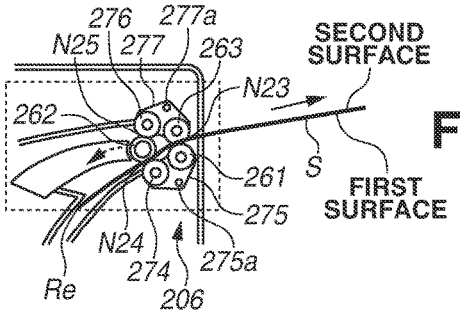

FIG. 15C is a schematic view illustrating a state where the drive roller 262 has further moved from the position illustrated in FIG. 15B. As illustrated in FIG. 15C, the discharge roller 261 and the reversing roller 263 contact each other via the sheet S to form a third nip portion N23, and the drive roller 262 and the sub roller 274 contact each other via the sheet S to form a fourth nip portion N24. In other words, the sheet S is conveyed in the first direction in a state (third state) where the first surface contacts the discharge roller 261 and the sub roller 274, the second surface contacts the drive roller 262 and the reversing roller 263, and the sheet S is nipped by the third nip portion N23 and the fourth nip portion N24. More specifically, in the reversing unit 206, when the drive roller 262 moves from the initial state to the retracted position, the sheet S nip state is switched from the first state to the third state by the switching unit.

Figure 15D:
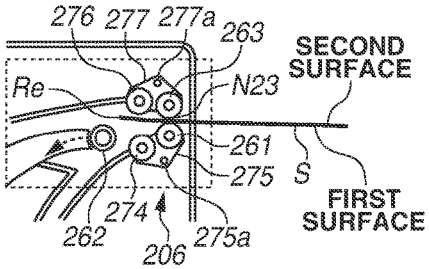

FIG. 15D is a schematic view illustrating a sheet S state when the drive roller 262 has moved to the retracted position (second position) where the moving amount of the drive roller 262 is maximized. When the drive roller 262 moves from the initial position to the retracted position as illustrated in FIG. 15D, the first nip portion N21 formed by the drive roller 262 and the discharge roller 261 and the fourth nip portion N24 formed by the drive roller 262 and the sub roller 274 are canceled. At this timing, the discharge roller 261 and the reversing roller 263 contact each other via the sheet S to form a third nip portion N23, the sheet S is nipped at the third nip portion N23, and the conveyance of the sheet S is held in a suspended state.

When the drive roller 262 moves from the initial position to the retracted position, forming a state where the sheet S is nipped by two different nip portions and nipping the sheet S at the third nip portion N23 enable preventing the sheet S from dropping from the reversing unit 206.

When the drive roller 262 moves to the retracted position, the trailing edge Re of the sheet S nipped at the third nip portion N23 moves above the drive roller 262 having moved to the retracted position due to the self-weight and rigidity of the sheet S or the nipped position and angle of the sheet S at the third nip portion N23. The drive roller 262, therefore, moves from the lower surface side, i.e., the first surface of the sheet S nipped by the third nip portion N23 to approach the discharge roller 261 and the reversing roller 263, i.e., the drive roller 262 moves from the retracted position to the initial position.

Figure 15E:
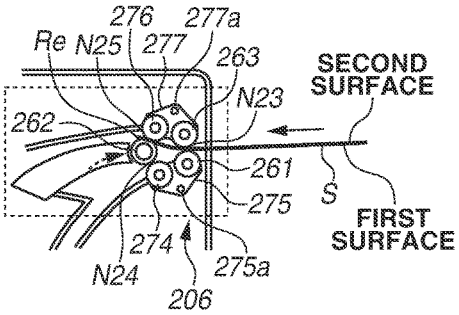

FIG. 15E is a schematic view illustrating a sheet S state while the drive roller 262 is moving from the retracted position to the initial position. As illustrated in FIG. 15E, the drive roller 262 moves from the lower surface side, i.e., the first surface of the sheet S nipped by the third nip portion N23 to approach the discharge roller 261 and the reversing roller 263, i.e., the drive roller 262 moves from the retracted position to the initial position. At this timing, the drive roller 262 contacts the sub roller 276 via the sheet S to form a fifth nip portion N25, and the sheet S is nipped at the fifth nip portion N25 and the third nip portion N23. The sub roller 276 is driven to rotate by the rotation of the drive roller 262, and the sheet S is conveyed at the fifth nip portion N25 in the second direction opposite to the first direction. Therefore, the sheet S is conveyed in the second direction in a state (third state) where the first surface contacts the discharge roller 261 and the drive roller 262 and the second surface contacts sub roller 276 and the reversing roller 263.

Subsequently, as the drive roller 262 moves to the initial position so as to widen the space between the discharge roller 261 and the reversing roller 263. Then, the third nip portion N23 formed by the discharge roller 261 and the reversing roller 263 is canceled, and the first nip portion N21 once formed by the contact between the drive roller 262 and the discharge roller 261 is reformed.

Figure 15F:
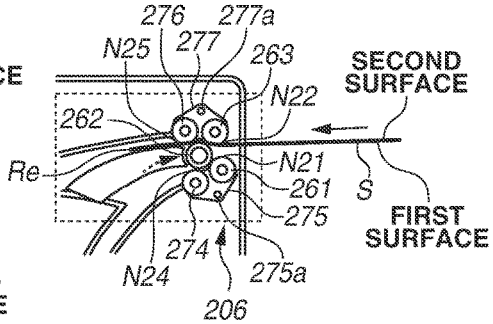

FIG. 15F is a schematic view illustrating a state where the drive roller 262 has further moved from the position illustrated in FIG. 15E. In the state illustrated in FIG. 15F, the drive roller 262 and the sub roller 276 contact each other via the sheet S to form a fifth nip portion N25, and the drive roller 262 and the reversing roller 263 contact each other to form a second nip portion N22. At this timing, the sheet S is conveyed in the second direction being nipped by two different positions (the fifth nip portion N25 and the second nip portion N22). In the state illustrated in FIG. 15F, the sheet S is conveyed in a state where the first surface contacts the drive roller 262 and the second surface contacts sub roller 276 and the reversing roller 263.

Figure 15G:
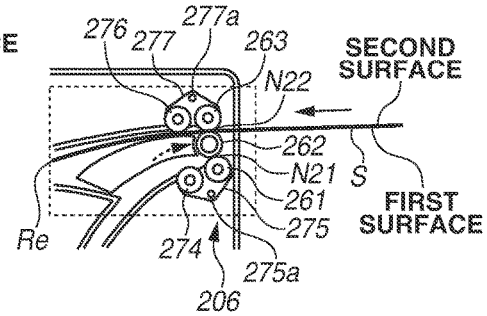

FIG. 15G is a schematic view illustrating a sheet S state when the drive roller 262 has moved to the initial position. As illustrated in FIG. 15G, upon completion of the moving operation of the drive roller 262, the sheet S having been held by the third nip portion N23 is nipped by the second nip portion N22 formed by the contact between the drive roller 262 and the reversing roller 263. In other words, in the reversing unit 206, when the drive roller 262 moves from the retracted position to the initial position, the sheet S nip state is switched from the third state to the second state by the switching unit. At this timing, the sheet S is nipped at the second nip portion N22 and conveyed in the second direction in a state (second state) where the first surface contacts the drive roller 262 and the second surface contacts the reversing roller 263.

As described above, the configuration of the modification enables acquiring a similar effect to the present exemplary embodiment. Further, in the configuration of the modification, providing a plurality of auxiliary rotating members enables reducing the conveyance resistance of the Sheet S both when the drive roller 262 moves from the initial position to the retracted position and when the drive roller 262 moves from the retracted position to the initial position. This enables improving the conveyance performance of the sheet S.

A third exemplary embodiment will be described below. The first exemplary embodiment has been described above centering on a configuration for switching the sheet S nip portion from the first nip portion N1 to the second nip portion N2 by moving the drive roller 62. On the other hand, the third exemplary embodiment will be described below centering on a configuration for switching the sheet S nip portion from the first nip portion N1 to the second nip portion N2 by moving a discharge roller 361 in a reversing unit 306 or moving a reversing roller 463 in a reversing unit 406. The configuration of the present exemplary embodiment is similar to that according to the first exemplary embodiment except the configurations of the reversing units 306 and 406, except that the discharge roller 361 is moved in the reversing unit 306, and except that the reversing roller 463 is moved in the reversing unit 406. The present exemplary embodiment, therefore, will be described below centering on differences from the first exemplary embodiment, and descriptions of elements similar to those in the first exemplary embodiment will be omitted.

A configuration of the reversing unit 306 for switching the sheet S nip portion by moving the discharge roller 361 will be described below with reference to FIGS. 16A, 16B, 17A, 17B, and 18A to 18E.

Figure 16A:
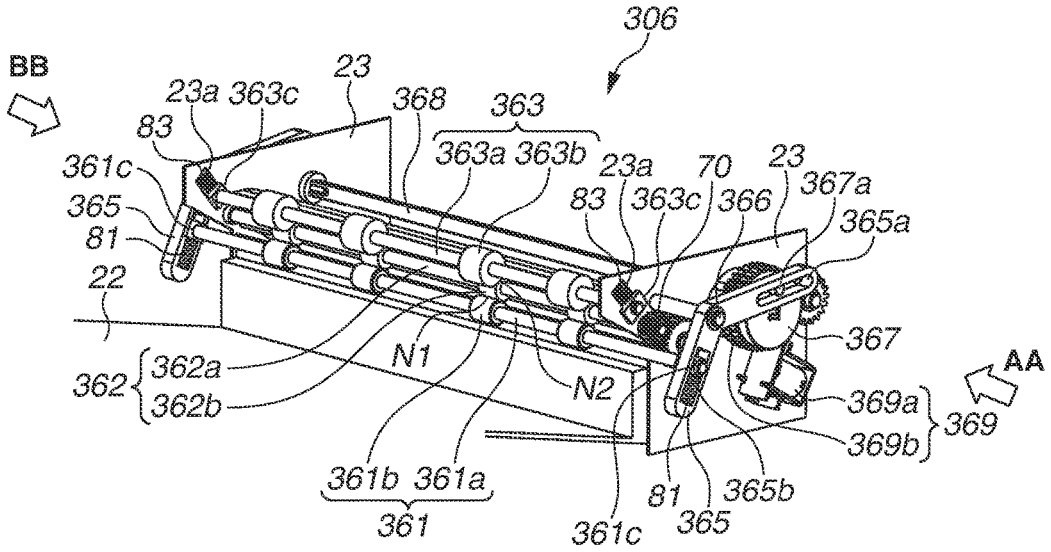
FIGS. 16A and 16B are schematic views illustrating a configuration of a reversing unit according to a third exemplary embodiment.

FIG. 16A is a schematic view illustrating a configuration of the reversing unit 306 according to the present exemplary embodiment when viewed from the downstream side in the sheet conveyance direction. As illustrated in FIG. 16A, a drive roller 362 (first rotary member) is composed of a shaft 362*a* and rubber contact portions 362*b*, and a reversing roller 363 (third rotary member) is composed of a shaft 363*a* and rubber contact portions 363*b*. The discharge roller 361 (second rotary member) is composed of a shaft 361*a* and rollers 361*b*. Although, in the present exemplary embodiment, the rollers 361*b* are formed on the shaft 361*a* as the discharge roller 361, the shaft 361*a* and the rollers 361*b* may be integrally formed as the discharge roller 361.

In the reversing unit 306, the drive roller 362 is rotatably held by a frame 23 of the main body 2. The drive roller 362 with one end connected to a gear 70 rotates while receiving a driving force from the drive motor 90 as a driving source via the gear 70. Since the drive motor 90 rotates in one direction, the drive roller 362 also rotates in one direction.

The discharge roller 361 is rotatably held on both ends by discharge roller bearings 361*c* provided in engagement slots 365*b* of discharge roller holders 365 which are rotatable centering on fulcrums 366. The discharge roller 361 is biased toward the drive roller 362 by springs (first biasing members) via the discharge roller bearings 361*c*, and a first nip portion N31 is formed by the discharge roller 361 and the drive roller 362 pressed by the discharge roller 361. The discharge roller holder 365 is provided with an engagement slot 365*b* for supporting the discharge roller 361 on one side of the fulcrum 366 and a guide groove 365*a* on the other side.

The reversing roller 363 is rotatably held by reversing roller bearings 363*c* movably held along with guide holes 23*a* provided on the frames 23 of the main body 2. The reversing roller 363 is biased toward the drive roller 362 by springs 83 (second biasing members) via the reversing roller bearings 363*c*, and a second nip portion N32 is formed by the reversing roller 363 and the drive roller 362 pressed by the reversing roller 363.

A cam shaft 368 is disposed to face the drive roller 362 in approximately parallel with the drive roller 362. Both ends of the cam shaft 368 are provided with cams 367 which are integrally rotatable with the cam shaft 368 via the frames 23. Each cam 367 has a cylindrical protruding portion 367*a* on the surface different from the surface holding the cam shaft 368. When the protruding portion 367*a* engages with the guide groove 365*a*, the cam 367 is held by the discharge roller holder 365. One end of the cam shaft 368 is provided with a cam drive unit 369 (formed of a solenoid 369*a* as a changeover member, and a partially-toothless gear 369*b*) that can turn the drive for rotating the cam 367 ON and OFF.

Figure 16B:
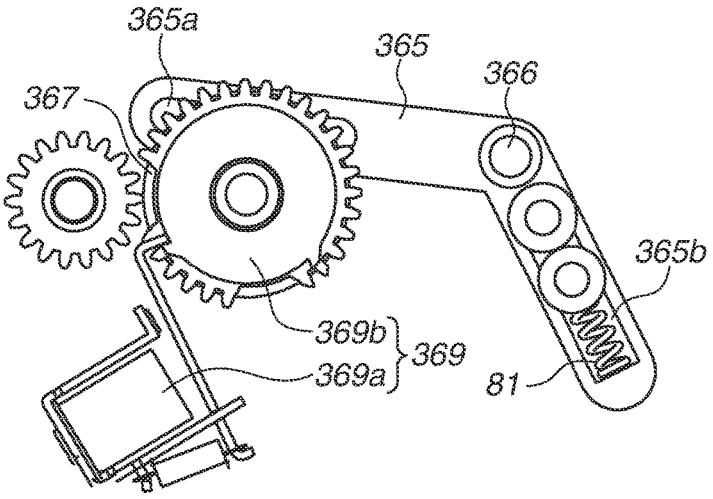

FIG. 16B is a schematic view illustrating a configurations of the discharge roller holder 365 and the cam drive unit 369 when viewed from the direction of the arrow BB illustrated in FIG. 16A. As illustrated in FIG. 16B, the partially-toothless gear 369*b* is provided with two different partially-toothless portions, and the solenoid 369*a* is provided with an engagement portion that can engage with the partially-toothless portions of the partially-toothless gear 369*b*. Thus, the partially-toothless gear 369*b* is configured to stop at two different positions at predetermined angular intervals in one revolution by turning the solenoid 369*a* ON and OFF.

Figure 17A:
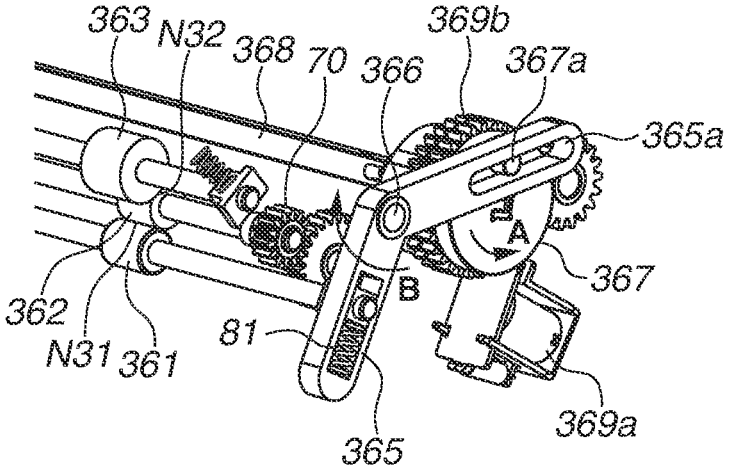
FIGS. 17A and 17B are schematic views illustrating a configuration of the reversing unit and an operational mechanism of a discharge roller according to the third exemplary embodiment.
Figure 17B:
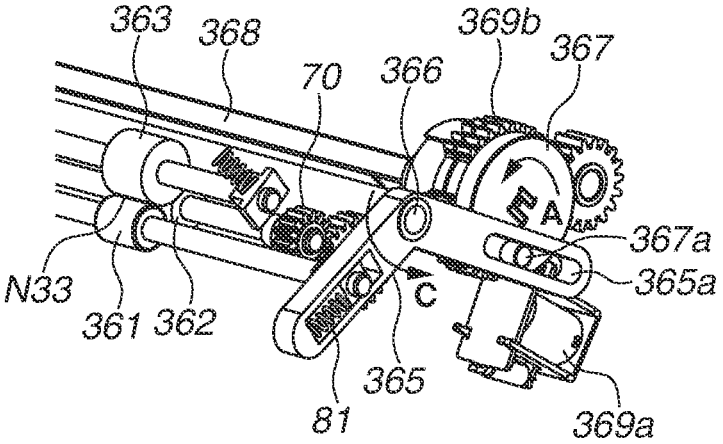

A moving operation of the discharge roller 361 in the reversing unit 306 will be described below with reference to FIGS. 17A and 17B. FIG. 17A is a schematic view illustrating a configuration of the reversing unit 306 before the moving operation of the discharge roller 361 is performed according to the present exemplary embodiment. FIG. 17B is a schematic view illustrating a configuration of the reversing unit 306 after the moving operation of the discharge roller 361 is performed according to the present exemplary embodiment. FIGS. 17A and 17B are schematic views illustrating the reversing unit 306 illustrated in FIG. 16A when viewed from the direction of the arrow AA.

In the state illustrated in FIG. 17A, the discharge roller 361 and the drive roller 362 contact each other to form a first nip portion N31, and the reversing roller 363 and the drive roller 362 contact each other to form a second nip portion N32. The discharge roller 361 has not yet started the moving operation. The position of the discharge roller 361 illustrated in FIG. 17A is assumed as the initial position (first position).

At this timing, the engagement portion of the solenoid 369*a* engages with the first partially-toothless portion of the partially-toothless gear 369*b*, the partially-toothless gear 369*b* is locked with the drive canceled, and the cam 367 stops without rotating. In this state, when the solenoid 369*a* is turned ON to unlock the partially-toothless gear 369*b*, the cam 367 rotates in the direction of the arrow A, as illustrated in FIG. 17A. With the rotation of the cam 367, the protruding portion 367*a* engaging with the guide groove 365*a* of the discharge roller holder 365 also starts rotating in the direction of the arrow A. Accordingly, the discharge roller holder 365 rotates in the direction of the arrow B centering on the fulcrum 366, and the discharge roller 361 supported on both ends by the discharge roller bearings 361*c* provided on the discharge roller holders 365 starts moving.

FIG. 17B illustrates the position of the discharge roller 361 when the discharge roller 361 moves by the rotation of the cam 367 and contacts the reversing roller 363. The position of the discharge roller 361 at this timing is assumed as a reversing position (second position). When the partially-toothless gear 369*b* rotates from the state illustrated in FIG. 17A and then the state illustrated in FIG. 17B is formed, the second partially-toothless portion of the partially-toothless gear 369*b* reaches the position where the second partially-toothless portion engages with the engagement portion of the solenoid 369*a*. At this timing, the solenoid 369*a* has already been turned OFF, the second partially-toothless portion of the partially-toothless gear 369*b* engages with the engagement portion of the solenoid 369*a*, the partially-toothless gear 369*b* is locked with the drive canceled, and the cam 367 stops rotating. Accordingly, the rotation of the discharge roller holder 365 stops, and the discharge roller 361 stops at the reversing position.

In this state, when the solenoid 369*a* is turned ON again and the partially-toothless gear 369*b* is unlocked, the cam 367 further rotates in the direction of the arrow A illustrated in FIG. 17B, and the discharge roller holder 365 rotates in the direction of the arrow C centering on the fulcrum 366. When the partially-toothless gear 369*b* rotates and the protruding portion 367*a* moves from the position illustrated in FIG. 17B to the position illustrated in FIG. 17A, the first partially-toothless portion of the partially-toothless gear 369*b* reaches the position where the first partially-toothless portion engages with the engagement portion of the solenoid 369*a*. At this timing, the solenoid 369*a* has already been turned OFF, the first partially-toothless portion of the partially-toothless gear 369*b* engages with the engagement portion of the solenoid 369*a*, the partially-toothless gear 369*b* is locked with the drive canceled, and the cam 367 stops rotating.

Accordingly, the discharge roller 361 moves from the reversing position to the initial position, and then stops moving at the initial position. When the discharge roller 361 moves from the reversing position, the discharge roller 361 and the drive roller 362 contact each other again to form a first nip portion N31. As described above, in the reversing unit 306, the above-described sequential moving operation of the reversing roller 363 is performed while the cam 367 makes one revolution by the cam drive unit 369.

A configuration for conveying the sheet S by the reversing unit 306 will be described below with reference to FIGS. 18A to 18E. FIGS. 18A to 18E are schematic views illustrating the reversing unit 306 illustrated in FIG. 16A when viewed from the direction of the arrow BB.

Figure 18A:
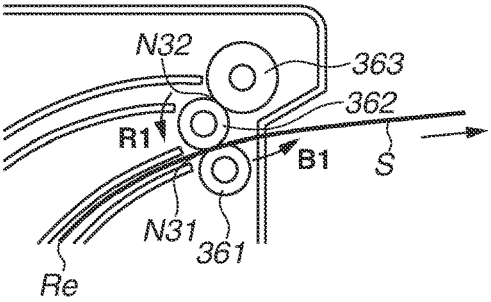
FIGS. 18A, 18B, 18C, 18D, and 18E are schematic views illustrating a moving operation of the discharge roller according to the third exemplary embodiment.

FIG. 18A is a sectional view schematically illustrating the reversing unit 306 before a moving operation of the discharge roller 361 is performed, when viewed from the axial direction of the discharge roller 361. In the state illustrated in FIG. 18A, the discharge roller 361 and the drive roller 362 contact each other to form a first nip portion N31, and the discharge roller 361 is rotating while receiving a rotary force from the drive roller 362 rotating in the direction of the arrow R1. Accordingly, the sheet S is conveyed in the first direction as the direction of sheet discharge from the main body 2 in a state (first state) where the first surface contacts the discharge roller 361 and the second surface contacts the drive roller 362 at the first nip portion N31. A second nip portion N32 is formed at the position where the reversing roller 363 and the drive roller 362 contact each other, and the reversing roller 363 is rotating while receiving a rotary force from the drive roller 362 rotating in the direction of the arrow R1. This enables conveying, at the second nip portion N32, the sheet S in the second direction opposite to the sheet S conveyance direction at the first nip portion N31.

According to the present exemplary embodiment, similar to the first exemplary embodiment, the discharge roller 361 starts the moving operation before the trailing edge Re of the sheet S conveyed in the first direction has been conveyed at the first nip portion N31, and moves in the direction of the arrow B1 from the initial position to the reversing position.

Figure 18B:
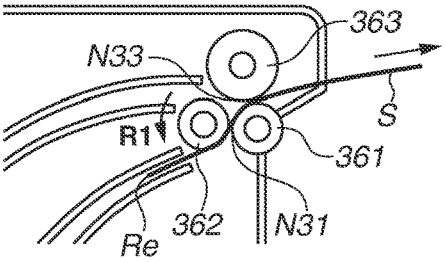

FIG. 18B is a sectional view schematically illustrating the reversing unit 306 when the discharge roller 361 has moved from the initial position to the reversing position, when viewed from the axial direction of the discharge roller 361. As illustrated in FIG. 18B, when the discharge roller 361 moves to the reversing position, a third nip portion N33 is formed by the discharge roller 361 and the reversing roller 363. At this timing, the discharge roller 361 and the drive roller 362 contact each other to form a first nip portion N31. Thus, the sheet S is nipped by the first nip portion N31 and the third nip portion N33 and conveyed in the first direction in a state (third state) where the first surface contacts the discharge roller 361, and the second surface contacts the drive roller 362 and the reversing roller 363. More specifically, in the reversing unit 306, when the discharge roller 361 moves from the initial state to the reversing position, the sheet S nip state is switched from the first state to the third state by the switching unit.

Figure 18C:
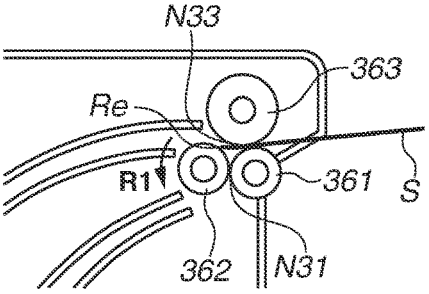

FIG. 18C is a sectional view schematically illustrating the reversing unit 306 when the sheet S has been further conveyed from the state illustrated in FIG. 18B, when viewed from the axial direction of the discharge roller 361. When the sheet S is further conveyed as illustrated in FIG. 18C, the trailing edge Re of the sheet S passes through the first nip portion N31 formed by the drive roller 362 and the discharge roller 361, and the sheet S conveyance is suspended. At this timing, the sheet S having been conveyed in the first direction at the first nip portion N1 is then nipped only by the third nip portion N33 formed by the discharge roller 361 and the reversing roller 363, and the sheet S conveyance is held in a suspended state.

Thus, according to the present exemplary embodiment, when the drive roller 361 moves from the initial position to the reversing position, the third state where the sheet S is nipped by two different positions (the first nip portion N31 and the third nip portion N33) is formed. Then, the sheet S is nipped by the third nip portion N33. This prevents the sheet S from dropping from the reversing unit 306 when switching the sheet S nip portion by moving the discharge roller 361.

Figure 18D:
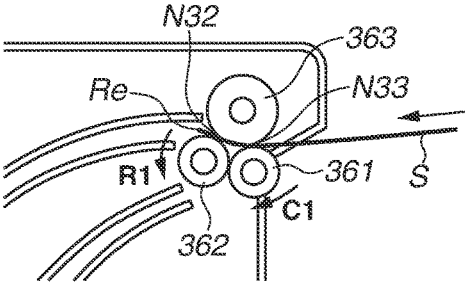

FIG. 18D is a sectional view schematically illustrating the reversing unit 306 when the discharge roller 361 moves from the reversing position to the initial position, when viewed from the axial direction of the discharge roller 361. As illustrated in FIG. 18D, the discharge roller 361 moves in the direction of the arrow C1 while in contact with the drive roller 362. At this timing, the reversing roller 363 rotates while receiving a rotary force from the drive roller 362 rotating in the direction of the arrow R1, and the sheet S is conveyed in the second direction at the second nip portion N32.

Figure 18E:
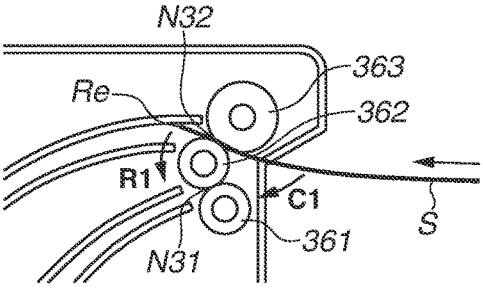

FIG. 18E is a sectional view schematically illustrating the reversing unit 306 when the discharge roller 361 has moved from the reversing position to the initial position, and the above-described sequential moving operation of the discharge roller 361 is completed, when viewed from the axial direction of the discharge roller 361. As illustrated in FIG. 18E, when the discharge roller 361 moves in the direction of the arrow C1 from the reversing position to the initial position, the third nip portion N33 is canceled, and the sheet S is nipped at the second nip portion N32 formed by the drive roller 362 and the reversing roller 363. At this timing, the sheet S is conveyed in the second direction in a state (second state) where the sheet S is nipped at the second nip portion N32, the first surface contacts the drive roller 362, and the second surface contacts the reversing roller 363. More specifically, in the reversing unit 306, when the discharge roller 361 moves from the reversing state to the initial position, the sheet S nip state is switched from the third state to the second state by the switching unit.

According to the present exemplary embodiment, the switching unit including the discharge roller holders 365, the cams 367, the cam shaft 368, and the cam drive units 369 moves the reversing roller 363 to switch the sheet S nip state from the first state to the second state. As described above, the configuration of the present exemplary embodiment also makes it possible to acquire a similar effect to the first exemplary embodiment.

A configuration of the reversing unit 406 capable of switching the sheet S nip portion by moving the reversing roller 463 will be described below with reference to FIGS. 19, 20A, 20B, and 21A to 21D.

Figure 19:
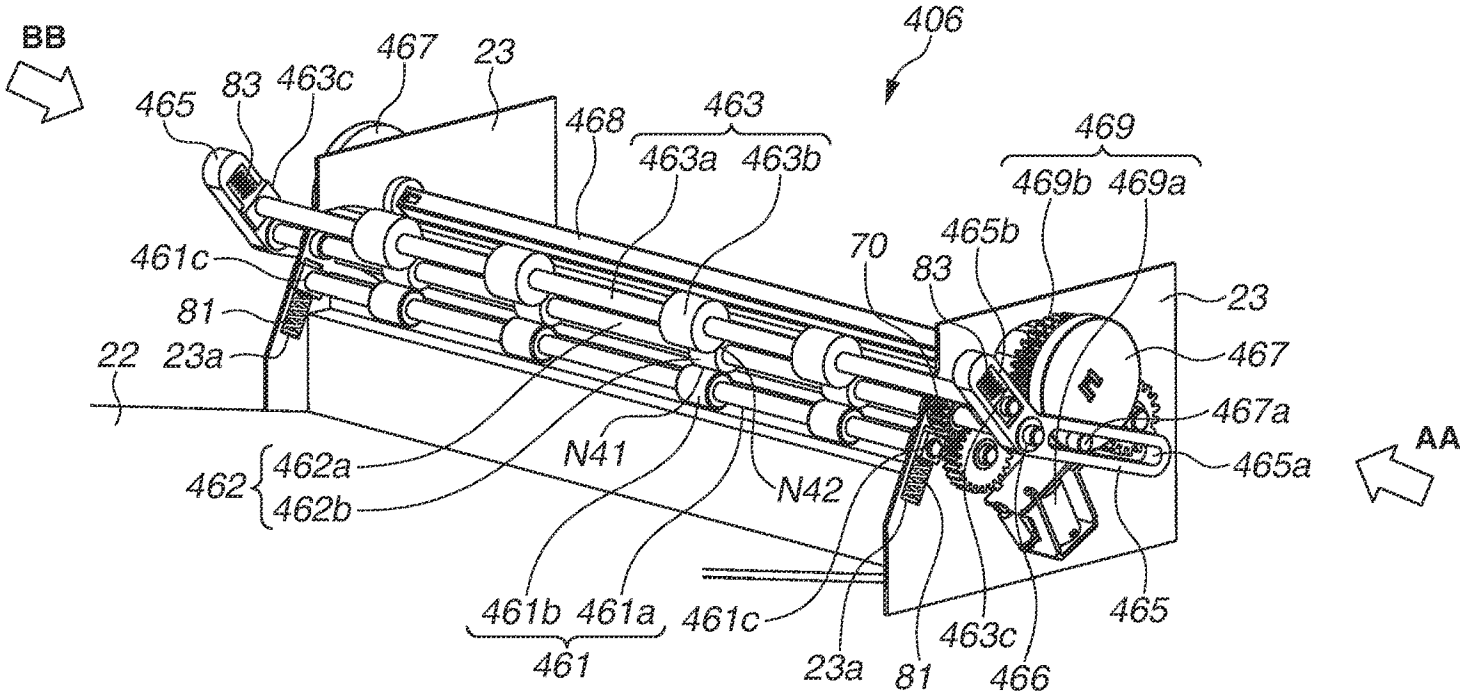
FIG. 19 is a schematic view illustrating another configuration of the reversing unit according to the third exemplary embodiment.

FIG. 19 is a schematic view illustrating a configuration of the reversing unit 406 according to the present exemplary embodiment when viewed from the downstream side in the sheet conveyance direction. As illustrated in FIG. 19, a drive roller 462 (first rotary member) is composed of a shaft 462*a* and rubber contact portions 462*b*, and the reversing roller 463 (second rotary member) is composed of a shaft 463*a* and rubber contact portions 463*b*. A discharge roller 461 (third rotary member) is composed of a shaft 461*a* and rollers 461*b* made of synthetic resin. Although, in the present exemplary embodiment, the rollers 461*b* are formed on the shaft 461*a* as the discharge roller 461, the shaft 461*a* and the rollers 461*b* may be integrally formed as the discharge roller 461.

The discharge roller 461 is rotatably held by discharge roller bearings 461*c* movably held along with guide holes 23*a* provided on the frames 23 of the main body 2. The discharge roller 461 is biased toward the drive roller 462 by springs 81 (first biasing members) via the discharge roller bearings 461*c*. When the drive roller 462 is pressed by the discharge roller 461, the drive roller 462 and the discharge roller 461 contact each other to form a first nip portion N41.

The drive roller 462 is rotatably held by the frames 23. The drive roller 462 with one end connected to a gear 70 rotates while receiving a driving force from the drive motor 90 as a driving source via the gear 70. Since the drive motor 90 rotates in one direction, the drive roller 462 also rotates in one direction. The reversing roller 463 is rotatably held on both ends by reversing roller bearings 463*c* provided in engagement slots 465*b* of reversing roller holders 465 which are rotatable centering on fulcrums 466. The reversing roller 463 is biased toward the drive roller 462 by springs 83 (second biasing members) via the reversing roller bearings 463*c*. When the drive roller 462 is pressed by the reversing roller 463, the drive roller 462 and the reversing roller 463 contact each other to form a second nip portion N42.

The inverting roller holder 465 includes an engagement slot 465*b* for supporting the inverting roller 463 on one side of the fulcrum 466, and a guide groove 465*a* on the other side. A cam shaft 468 is disposed to face the drive roller 462 in approximately parallel with the drive roller 462. Both ends of the cam shaft 468 are provided with cams 467 which are integrally rotatable around the cam shaft 468. Each cam 467 has a cylindrical protruding portion 467*a* on the surface different from the surface holding the cam shaft 468. When the protruding portion 467*a* engages with the guide groove 465*a*, the cam 467 is held by the discharge roller holder 465. One end of the cam shaft 468 is provided with a cam drive unit 469 (formed of a solenoid 469*a* as a changeover member, and a partially-toothless gear 469*b*) that can turn the drive for rotating the cam 467 ON and OFF. Similar to the first exemplary embodiment, the partially-toothless gear 469*b* is provided with two different partially-toothless portions, and the solenoid 469*a* is provided with an engagement portion that can engage with the partially-toothless portions of the partially-toothless gear 469*b*. Thus, the partially-toothless gear 469*b* is configured to stop at two different positions at predetermined angular intervals in one revolution by turning the solenoid 469*a* ON and OFF.

Figure 20A:
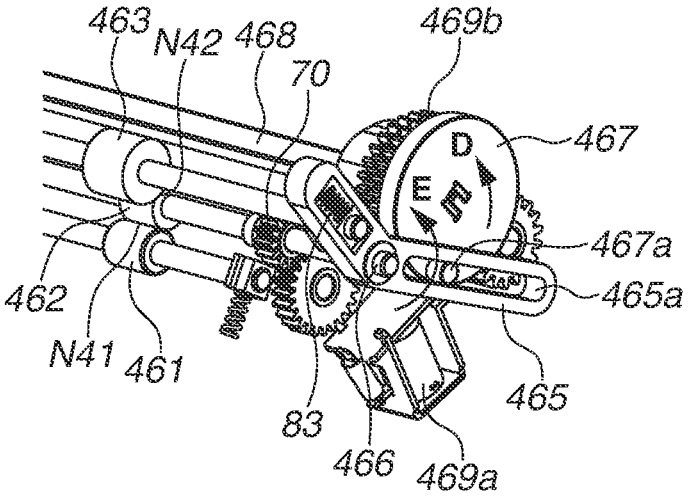
FIGS. 20A and 20B are schematic views illustrating another configuration of the reversing unit and an operation of the reversing roller according to the third exemplary embodiment.
Figure 20B:
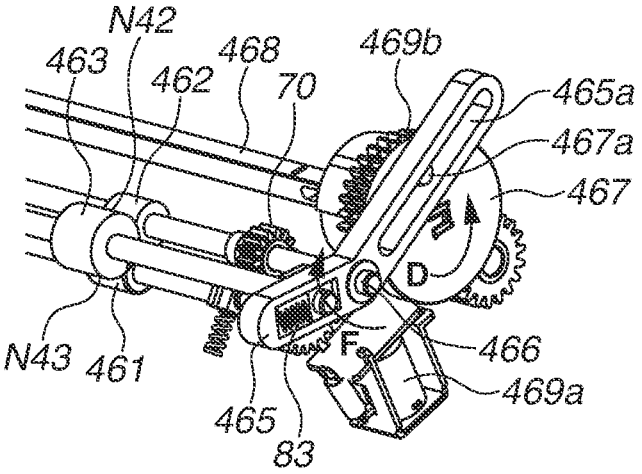

A moving operation of the reversing roller 463 in the reversing unit 406 will be described below with reference to FIGS. 20A and 20B. FIG. 20A is a schematic view illustrating a configuration of the reversing unit 406 before the moving operation of the reversing roller 463 is performed according to the present exemplary embodiment. FIG. 20B is a schematic view illustrating a configuration of the reversing unit 406 after the moving operation of the reversing roller 463 is performed according to the present exemplary embodiment. FIGS. 20A and 20B are schematic views illustrating the reversing unit 406 illustrated in FIG. 19 when viewed from the direction of the arrow AA.

In the state illustrated in FIG. 20A, the discharge roller 461 contacts the drive roller 462 to form a first nip portion N41, and the reversing roller 463 contacts the drive roller 462 to form a second nip portion N42. The discharge roller 461 has not yet started the moving operation in the state illustrated in FIG. 20A. The position of the reversing roller 463 illustrated in FIG. 20A is assumed as the initial position (first position).

At this timing, the engagement portion of the solenoid 469*a* engages with the first partially-toothless portion of the partially-toothless gear 469*b*, the partially-toothless gear 469*b* is locked with the drive canceled, and the cam 467 stops without rotating. In this state, when the solenoid 469*a* is turned ON to unlock the partially-toothless gear 469*b*, the cam 467 rotates in the direction of the arrow D, as illustrated in FIG. 20A. With the rotation of the cam 467, the protruding portion 467*a* engaging with the guide groove 465*a* of the inverting roller holder 465 also starts rotating in the direction of the arrow D. Accordingly, the reversing roller holders 465 rotate in the direction of the arrow E centering on the fulcrums 466, and the reversing roller 463 supported on both ends by the reversing roller bearings 463*c* provided in the reversing roller holders 465 starts moving.

FIG. 20B illustrates the position of the reversing roller 463 when the reversing roller 463 moves by the rotation of the cam 467 and contacts the discharge roller 461. The position of the reversing roller 463 at this timing is assumed as the reversing position (second position). When the partially-toothless gear 469*b* rotates from the state illustrated in FIG. 20A and then the state illustrated in FIG. 20B is formed, the second partially-toothless portion of the partially-toothless gear 469*b* reaches the position where the second partially-toothless portion engages with the engagement portion of the solenoid 469*a*. At this timing, the solenoid 469*a* has already been turned OFF. Therefore, the second partially-toothless portion of the partially-toothless gear 469*b* engages with the engagement portion of the solenoid 469*a*, the partially-toothless gear 469*b* is locked with the drive canceled, and the cam 467 stops rotating. Accordingly, the rotation of the reversing roller holders 465 stops, and the reversing roller 463 stops at the reversing position.

In this state, when the solenoid 469*a* is turned ON again and the partially-toothless gear 469*b* is unlocked, the cam 467 further rotates in the direction of the arrow D illustrated in FIG. 20B, and the reversing roller holder 465 rotates in the direction of the arrow F centering on the fulcrum 466. When the partially-toothless gear 469*b* rotates and the protruding portion 467*a* moves from the position illustrated in FIG. 20B to the position illustrated in FIG. 20A, the first partially-toothless portion of the partially-toothless gear 469*b* reaches the position where the first partially-toothless portion engages with the engagement portion of the solenoid 469*a*. At this timing, the solenoid 469*a* has already been turned OFF. Therefore, the first partially-toothless portion of the partially-toothless gear 469*b* engages with the engagement portion of the solenoid 469*a*, the partially-toothless gear 469*b* is locked with the drive canceled, and the cam 467 stops rotating.

Accordingly, the reversing roller 463 moves from the reversing position to the initial position, and then stops moving at the initial position. When the reversing roller 463 moves from the reversing position, the discharge roller 461 and the drive roller 462 contact each other again to form a first nip portion N41. As described above, in the reversing unit 406, the above-described sequential moving operation of the reversing roller 463 is performed while the cam 467 makes one revolution by the cam drive unit 469.

A configuration for conveying the sheet S by the reversing unit 406 will be described below with reference to FIGS. 21A to 21E. FIGS. 21A to 21E are schematic views illustrating the reversing unit 406 illustrated in FIG. 19 when viewed from the direction of the arrow BB.

Figure 21A:
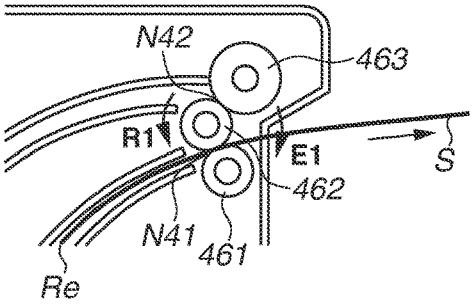
FIGS. 21A, 21B, 21C, 21D, and 21E are schematic views illustrating another configuration and a moving operation of the reversing roller according to the third exemplary embodiment.

FIG. 21A is a sectional view schematically illustrating the reversing unit 406 before a moving operation of the reversing roller 463 is performed, when viewed from the axial direction of the reversing roller 463. In the state illustrated in FIG. 21A, the discharge roller 461 and the drive roller 462 contact each other to form a first nip portion N41, and the discharge roller 461 is rotating while receiving a rotary force from the drive roller 462 rotating in the direction of the arrow R1. Thus, the sheet S is conveyed in the first direction as the direction of sheet discharge from the main body 2 in a state (first state) where the first surface contacts the discharge roller 461 and the second surface contacts the drive roller 462 at the first nip portion N41. A second nip portion N42 is formed at the position where the reversing roller 463 and the drive roller 462 contact each other, and the reversing roller 463 is rotating while receiving a rotary force from the drive roller 462 rotating in the direction of the arrow R1. This enables conveying, at the second nip portion N42, the sheet S in the second direction opposite to the sheet S conveyance direction at the first nip portion N41.

According to the present exemplary embodiment, similar to the first exemplary embodiment, the reversing roller 463 starts the moving operation before the trailing edge Re of the sheet S conveyed in the first direction has been conveyed at the first nip portion N41, and moves in the direction of the arrow E1 from the initial position to the reversing position.

Figure 21B:
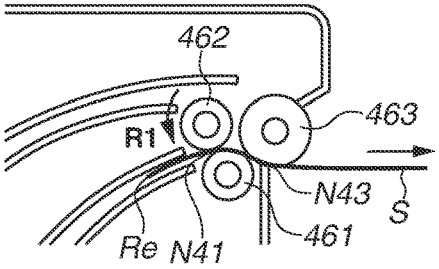

FIG. 21B is a sectional view schematically illustrating the reversing unit 406 when the reversing roller 463 has moved from the initial position to the reversing position, when viewed from the axial direction of the reversing roller 463. As illustrated in FIG. 21B, when the reversing roller 463 moves to the reversing position, a third nip portion N43 is formed by the reversing roller 463 and the discharge roller 461. At this timing, the discharge roller 461 and the drive roller 462 contact each other to form the first nip portion N41. Then, the sheet S is nipped by the first nip portion N41 and the third nip portion N43 and conveyed in the first direction in a state (third state) where the first surface contacts the discharge roller 461, and the second surface contacts the drive roller 462 and the reversing roller 463. More specifically, in the reversing unit 406, when the reversing roller 463 moves from the initial state to the reversing position, the sheet S nip state is switched from the first state to the third state by the switching unit.

Figure 21C:
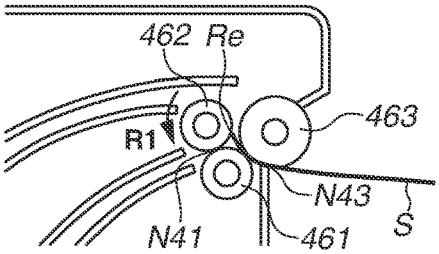

FIG. 21C is a sectional view schematically illustrating the reversing unit 406 when the sheet S has been further conveyed from the state illustrated in FIG. 21B, when viewed from the axial direction of the reversing roller 463. When the sheet S is further conveyed as illustrated in FIG. 21C, the trailing edge Re of the sheet S passes through the first nip portion N41 formed by the drive roller 462 and the discharge roller 461, and the sheet S conveyance is suspended. At this timing, the sheet S having been conveyed in the first direction at the first nip portion N41 is then nipped only by the third nip portion N43 formed by the discharge roller 461 and the reversing roller 463, and the sheet S conveyance is held in a suspended state.

Thus, according to the present exemplary embodiment, when the drive roller 463 moves from the initial position to the reversing position, the third state where the sheet S is nipped by two different positions (the first nip portion N41 and the third nip portion N43) is formed. Then, the sheet S is nipped by the third nip portion N43. This prevents the sheet S from dropping from the reversing unit 406 when switching the sheet S nip portion by moving the reversing roller 463.

Figure 21D:
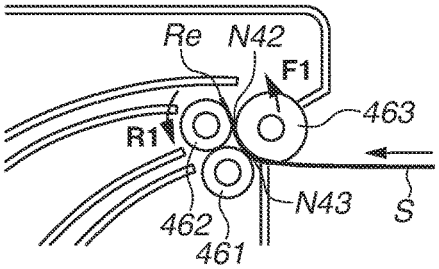

FIG. 21D is a sectional view schematically illustrating the reversing unit 406 when the reversing roller 463 moves from the reversing position to the initial position, when viewed from the axial direction of the reversing roller 463. As illustrated in FIG. 21D, the reversing roller 463 moves in the direction of the arrow F1 while in contact with the drive roller 462. At this timing, the reversing roller 463 contacts the drive roller 462 to form a second nip portion N42, the reversing roller 463 rotates while receiving a rotary force from the drive roller 462 rotating in the direction of the arrow R1, and the sheet S is conveyed in the second direction at the second nip portion N42.

Figure 21E:
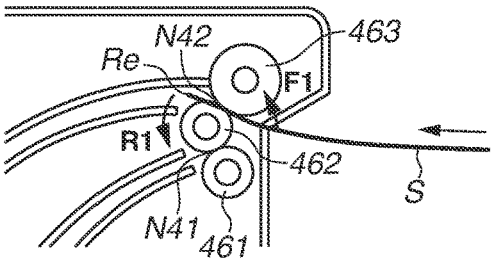

FIG. 21E is a sectional view schematically illustrating the reversing unit 406 when the reversing roller 463 has moved from the reversing position to the initial position, and the above-described sequential moving operation of the reversing roller 463 is completed, when viewed from the axial direction of the reversing roller 463. As illustrated in FIG. 21E, when the reversing roller 463 moves in the direction of the arrow F1 from the reversing position to the initial positions, the third nip portion N43 is canceled, and the sheet S is nipped at the second nip portion N42 formed by the drive roller 462 and the reversing roller 463. At this timing, the sheet S is conveyed in the second direction in a state (second state) where the sheet S is nipped at the second nip portion N42, the first surface contacts the drive roller 462, and the second surface contacts the reversing roller 463. More specifically, in the reversing unit 406, when the reversing roller 463 moves from the reversing state to the initial position, the sheet S nip state is switched from the third state to the second state by the switching unit.

According to the present exemplary embodiment, the switching unit including the reversing roller holders 465, the cams 467, the cam shaft 468, and the cam drive units 469 moves the reversing roller 463 to switch the sheet S nip state from the first state to the second state. As described above, the configuration of the present exemplary embodiment also makes it possible to acquire a similar effect to the first exemplary embodiment.

Although the above-described exemplary embodiments have been described centering on cases where the present invention is applied to an electrophotographic image forming apparatus, the present invention is not limited thereto. For example, the present invention may be applied to other than an electrophotographic image forming apparatus, such as an ink-jet image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-193513, filed Sep. 30, 2016, which is hereby incorporated by reference herein in its entirety.

What is claimed is:

1. A sheet conveying apparatus comprising:

a first rotary member configured to rotate in one direction;

a second rotary member configured to convey a sheet in a first direction together with the first rotary member with a rotation of the first rotary member;

a third rotary member configured to convey the sheet in a second direction different from the first direction together with the first rotary member with a rotation of the first rotary member; and a switching unit configured to move the first rotary member before a trailing edge of the sheet conveyed in the first direction has been conveyed by the first and the second rotary members to switch from a first state to a second state, wherein the first state is a state where the second rotary member contacts a first surface of the sheet and the first rotary member contacts a second surface opposite to the first surface of the sheet, wherein the second state is a state where the first rotary member contacts the first surface of the sheet and the third rotary member contacts the second surface of the sheet, wherein the switching unit switches from the first state to a third state and then switches from the third state to the second state, wherein the third state is a state where the first rotary member contacts the first or the second surface of the sheet, the second rotary member contacts the first surface of the sheet, and the third rotary member contacts the second surface of the sheet.

2. The sheet conveying apparatus according to claim 1, wherein the third state is a state where the first and the third rotary members contact the second surface of the sheet, and the second rotary member contacts the first surface of the sheet.

3. The sheet conveying apparatus according to claim 2, wherein the second rotary member contacts the first rotary member to form a first nip portion for nipping a sheet, and the third rotary member contacts the first rotary member at a position different from a position of the second rotary member in a circumferential direction of the first rotary member to form a second nip portion for nipping a sheet.

4. The sheet conveying apparatus according to claim 3, wherein the third state is a state where the first nip portion is formed by the first and the second rotary members, a third nip portion for nipping a sheet is formed by the second and the third rotary members, and the sheet is nipped by the first and the third nip portions.

5. The sheet conveying apparatus according to claim 3, further comprising:

an auxiliary rotary member disposed on an upstream side of the second rotary member in the first direction;

a first holding member configured to hold the auxiliary and the second rotary members; and a biasing member configured to bias the first holding member toward the first rotary member, wherein the third state is a state where a third nip portion for nipping a sheet is formed by the second and the third rotary members, a fourth nip portion for nipping a sheet is formed by the first and the auxiliary rotary members, and the sheet is nipped by the third and the fourth nip portions.

6. The sheet conveying apparatus according to claim 1, wherein the third state is a state where the first and the second rotary members contact the first surface of the sheet, and the third rotary member contacts the second surface of the sheet.

7. The sheet conveying apparatus according to claim 6, wherein the second rotary member contacts the first rotary member to form a first nip portion for nipping a sheet, and the third rotary member contacts the first rotary member at a position different from a position of the second rotary member in a circumferential direction of the first rotary member to form a second nip portion for nipping a sheet.

8. The sheet conveying apparatus according to claim 7, wherein the third state is a state where the second nip portion is formed by the first and the third rotary members, a third nip portion for nipping a sheet is formed by the second and the third rotary members, and the sheet is nipped by the second and the third nip portions.

9. The sheet conveying apparatus according to claim 7, further comprising:

an auxiliary rotary member disposed on an upstream side of the third rotary member in the first direction;

a second holding member configured to hold the auxiliary and the third rotary members; and a biasing member configured to bias the second holding member toward the first rotary member, wherein the third state is a state where a third nip portion for nipping a sheet is formed by the second and the third rotary members, a fifth nip portion for nipping a sheet is formed by the first and the auxiliary rotary members, and the sheet is nipped by the third and the fifth nip portions.

10. The sheet conveying apparatus according to claim 1, wherein the switching unit moves the first rotary member in a direction away from at least one of the second and the third rotary members, and then moves the first rotary member to a position where the first rotary member can convey the sheet together with the second or the third rotary member, to switch from the first state to the second state.

11. The sheet conveying apparatus according to claim 1, further comprising a drive motor configured to rotate in one direction, wherein the first rotary member rotates in one direction while receiving a driving force from the drive motor.

12. The sheet conveying apparatus according to claim 1, further comprising:

a stacking unit configured to stack discharged sheets;

a first conveyance path configured to convey the sheet toward the first and the second rotary members; and a second conveyance path configured to re-convey, to the first conveyance path, the sheet having been conveyed in the first direction by the first and the second rotary members, wherein the first direction is a direction in which the sheet is conveyed from the first rotary member toward the stacking unit by the first and the second rotary members, and the second direction is a direction in which the sheet is conveyed from the stacking unit toward the second conveyance path by the first and the third rotary members.

13. An image forming apparatus comprising:

the sheet conveying apparatus according to claim 1, and an image forming unit for forming an image on the sheet.

14. A sheet conveying apparatus comprising:

a first rotary member configured to rotate in one direction;

a second rotary member configured to convey a sheet in a first direction together with the first rotary member with a rotation of the first rotary member;

a third rotary member configured to convey the sheet in a second direction different from the first direction together with the first rotary member with a rotation of the first rotary member; and a switching unit configured to move the second or the third rotary member before a trailing edge of the sheet conveyed in the first direction has been conveyed by the first and the second rotary members to switch from a first state to a second state, wherein the first state is a state where the second rotary member contacts a first surface of the sheet and the first rotary member contacts a second surface opposite to the first surface of the sheet, wherein the second state is a state where the first rotary member contacts the first surface of the sheet and the third rotary member contacts the second surface of the sheet, wherein the switching unit switches from the first state to a third state and then switches from the third state to the second state, wherein the third state is a state where the first rotary member contacts the first or the second surface of the sheet, the second rotary member contacts the first surface of the sheet, and the third rotary member contacts the second surface of the sheet.

15. The sheet conveying apparatus according to claim 14, wherein the second rotary member contacts the first rotary member to form a first nip portion for nipping a sheet, and the third rotary member contacts the first rotary member at a position different from a position of the second rotary member in a circumference direction of the first rotary member to form a second nip portion for nipping a sheet, wherein the third state is a state where a third nip portion for nipping a sheet is formed by the second and the third rotary members, and the sheet is nipped by the first and the third nip portions, and wherein, in the third state, the first surface of the sheet contacts the second rotary member, and the second surface of the sheet contacts the first and the third rotary members.

16. The sheet conveying apparatus according to claim 14, wherein the second rotary member contacts the first rotary member to form a first nip portion for nipping a sheet, and the third rotary member contacts the first rotary member at a position different from a position of the second rotary member in a circumference direction of the first rotary member to form a second nip portion for nipping a sheet, wherein the third state is a state where a third nip portion for nipping a sheet is formed by the second and the third rotary members, and the sheet is nipped by the second and the third nip portions, and wherein, in the third state, the first surface of the sheet contacts the first and the second rotary members, and the second surface of the sheet contacts the third rotary member.

17. The sheet conveying apparatus according to claim 14, further comprising a drive motor configured to rotate in one direction, wherein the first rotary member rotates in one direction while receiving a driving force from the drive motor.

18. The sheet conveying apparatus according to claim 14, further comprising:

a stacking unit configured to stack discharged sheets;

a first conveyance path configured to convey the sheet toward the first and the second rotary members; and a second conveyance path configured to re-convey, to the first conveyance path, the sheet having been conveyed in the first direction by the first and the second rotary members, wherein the first direction is a direction in which the sheet is conveyed from the first rotary member toward the stacking unit by the first and the second rotary members, and the second direction is a direction in which the sheet is conveyed from the stacking unit toward the second conveyance path by the first and the third rotary members.

19. An image forming apparatus comprising:

the sheet conveying apparatus according to claim 14, and an image forming unit for forming an image on the sheet.

* * * * *